US008361243B2

(12) United States Patent
Sung

(10) Patent No.: US 8,361,243 B2
(45) Date of Patent: Jan. 29, 2013

(54) METHOD OF FORMING {100} TEXTURE ON SURFACE OF IRON OR IRON-BASE ALLOY SHEET, METHOD OF MANUFACTURING NON-ORIENTED ELECTRICAL STEEL SHEET BY USING THE SAME AND NON-ORIENTED ELECTRICAL STEEL SHEET MANUFACTURED BY USING THE SAME

(76) Inventor: Jin Kyung Sung, Pohang-si (KR)

( * ) Notice: Subject to any disclaimer, the term of this patent is extended or adjusted under 35 U.S.C. 154(b) by 504 days.

(21) Appl. No.: 12/520,635

(22) PCT Filed: Dec. 21, 2007

(86) PCT No.: PCT/KR2007/006737

§ 371 (c)(1),
(2), (4) Date: Jun. 22, 2009

(87) PCT Pub. No.: WO2008/078921

PCT Pub. Date: Jul. 3, 2008

(65) Prior Publication Data

US 2010/0043928 A1 Feb. 25, 2010

(30) Foreign Application Priority Data

Dec. 22, 2006 (KR) ..... 10-2006-0133074

(51) Int. Cl.
*C21D 8/12* (2006.01)

(52) U.S. Cl. ..... 148/112; 148/113; 148/308; 148/307

(58) Field of Classification Search ..... 148/306–308, 148/110–113

See application file for complete search history.

(56) References Cited

U.S. PATENT DOCUMENTS

| | | | | |
|---|---|---|---|---|
| 4,326,899 | A * | 4/1982 | Henricks | 148/120 |
| 2004/0149355 | A1 * | 8/2004 | Kohno et al. | 148/111 |

FOREIGN PATENT DOCUMENTS

| | | | |
|---|---|---|---|
| JP | 1-108345 | A | 4/1989 |
| JP | 2535963 | B | 4/1989 |
| JP | 401319632 | A * | 12/1989 |
| JP | 02-107718 | A | 4/1990 |
| JP | 07-173538 | A | 7/1995 |
| KR | 100244653 | B1 | 11/1999 |

OTHER PUBLICATIONS

English-hand translation of Japanese patent 401319632A, Tomita, Toshiro , Dec. 25, 1989.*

* cited by examiner

*Primary Examiner* — Deborah Yee
(74) *Attorney, Agent, or Firm* — Kile Park Goekjian Reed & McManus PLLC

(57) ABSTRACT

An iron or iron-base alloy sheet having high proportion of {100} texture and a method of manufacturing the same. A method of forming grains having {100} plane parallel to the sheet surface is disclosed. A Fe or Fe-base alloy sheet is annealed at austenite (γ) temperature while minimizing an effect of oxygen in the sheet or on surfaces of the sheet or a heat treatment atmosphere, and then the above sheet is subject to phase transformation to ferrite (α). On surfaces of the resulting sheet, a high proportion of {100} texture develops. A method of manufacturing electrical steel sheet is disclosed. The grains with {100} texture on surfaces grow to have a grain size of at least half the thickness of the sheet by a γ→α transformation. By adopting the above disclosed methods, an iron or iron-base alloy sheet with excellent texture can be simply manufactured within short time.

23 Claims, 21 Drawing Sheets

Alloy: Pure Iron 1
Soaking Temperature: 930°C
Soaking Time: 1min
Annealing Atmosphere: $H_2$ gas, 1atm
Cooling Rate : 600°C/hr Alloy: Fe-1.0%Si
Soaking Temperature: 1150°C
Soaking Time: 15min
Annealing Atmosphere: $6x10^{-6}$torr, Ti getter Cooling Rate: Vacuum Cooling
Average Grain Size: 115μm
$P_{100}$=3.16

Cooling Rate: 25°C/hr
Average Grain Size: 235μm
$P_{100}$=10.81

Alloy: Fe-1.5%Si-0.1%C

Annealing for {100} Texture
Soaking Temperature: 1100°C
Soaking Time: 10min
Atmosphere: Vacuum, $5x10^{-6}$torr

Grain Growth by Decarburization
Temperature: 950°C
Time: 15min
Atmosphere: $N_2$-20%$H_2$ (Dew Point : 30 ℃)

METHOD OF FORMING {100} TEXTURE ON SURFACE OF IRON OR IRON-BASE ALLOY SHEET, METHOD OF MANUFACTURING NON-ORIENTED ELECTRICAL STEEL SHEET BY USING THE SAME AND NON-ORIENTED ELECTRICAL STEEL SHEET MANUFACTURED BY USING THE SAME

CROSS-REFERENCE TO RELATED APPLICATION

This application claims the benefit of Korean Patent Applications No. 10-2006-0133074, filed on Dec. 22, 2006 in the Korean Intellectual Property Office, the entire disclosure of which is incorporated herein by reference.

BACKGROUND OF THE INVENTION

1. Field of the Invention

The present invention relates generally to non-oriented electrical steel sheet, having excellent texture characteristics for use in motors, generators, small sized transformers and the like, and a method for manufacturing the same.

2. Description of Related Art

Soft magnetic steel sheets require two major magnetic properties such as a low core loss and a high magnetic flux density. The methods of reducing the iron loss of the soft magnetic steel sheets include facilitating the movements of magnetic domains (reducing hysteresis loss), and increasing the resistivity (reducing eddy current loss).

In order to facilitate the movement of the magnetic domains, impurities such as oxygen, carbon, nitrogen, and titanium should be removed to improve the purity of the iron or iron-base alloys. In order to increase the resistivity, contents of silicon, aluminum and manganese should be increased.

Since Fe-base bcc (body-centered cubic) crystals are magnetically anisotropic, crystallographic texture is known to affect magnetic properties of iron or iron-base alloy sheets significantly. The optimum texture of non-oriented electrical steel sheets is {100} plane parallel to the sheet surface (hereafter referred as {100} texture) because the {100} plane has two easy magnetization directions, <001>, and no hard magnetization direction, <111>.

There are known methods for manufacturing {100} texture. When a thin Fe-3% Si was annealed in $H_2S$ atmosphere at not less than 1000° C., preferential growth of grains with {100} planes parallel to the surface of the sheet was observed. Sulfur or oxygen is considered to adsorb on the surface and cause the anisotropy of the surface energy at the annealing atmosphere. In the direct casting method which the present inventor disclosed in Korean Patent Application Laid-open No. 95-48472/1995, a high density {100} texture is observed in silicon steel sheet. However, since the silicon steel sheet has a rough surface and irregular thickness, the problems should be resolved to use the silicon steel sheet as electrical steels.

As mentioned above, there are known methods for manufacturing a soft magnetic steel sheets with {100} texture. However, since these processes have problems for mass production, it is not easy to manufacture the soft magnetic steel sheet with {100} texture commercially.

SUMMARY OF THE INVENTION

The present invention is intended to overcome the above described disadvantages of the conventional techniques.

It is an objective of the present invention to provide a repeatable, effective and efficient method for manufacturing a soft magnetic steel sheet with a high proportion of {100} texture by an annealing process.

The present invention discloses that when Fe or a Fe-base alloy sheet is annealed at an austenite temperature region while minimizing an effect of oxygen in the sheet or on surfaces of the sheet or in a heat treatment atmosphere, and also when the above sheet is subject to phase transformation to ferrite, a high density {100} texture develops on the sheet surfaces.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
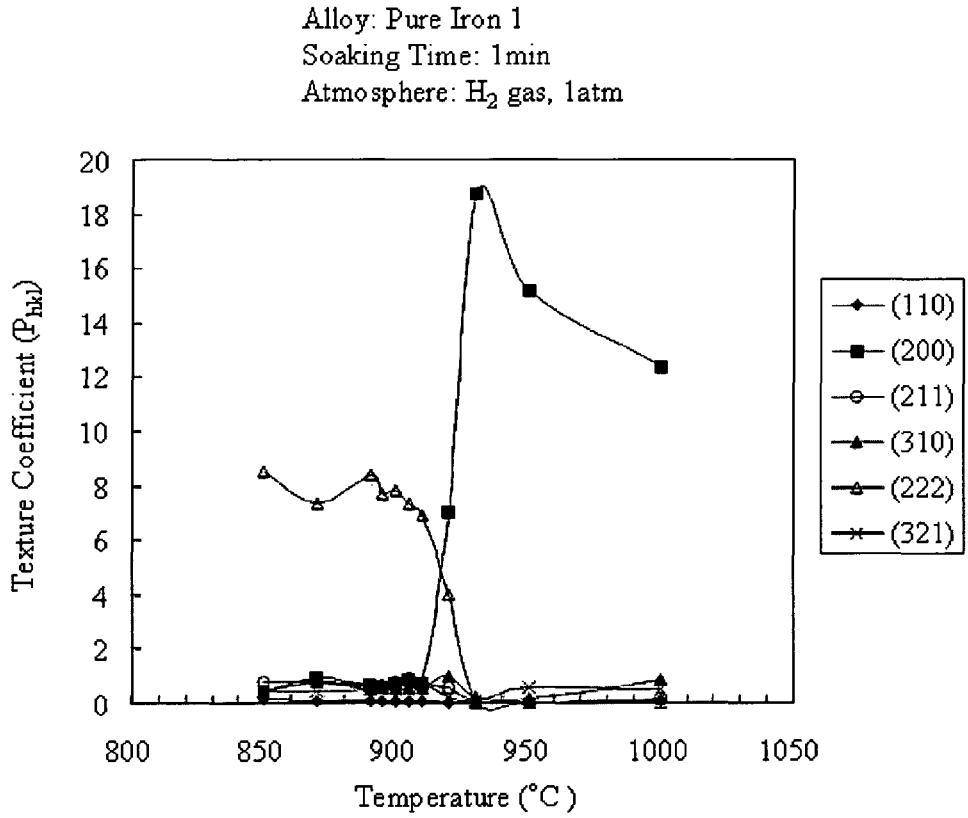
FIG. 1 is a graph showing an effect of annealing temperature on the formation of {100} texture, which was developed by annealing in 1 atm $H_2$ atmosphere for pure iron 1.

The invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art.

A method of forming grains on surfaces with {100} plane parallel to the surface of the sheet includes steps of i) an iron or iron-base alloy sheet is annealed while minimizing an effect of oxygen in the sheet or on surfaces of the sheet or in a heat treatment atmosphere, ii) the above sheet is annealed or heat-treated at the temperature range where the stable phase of the said alloy is austenite (γ) (hereafter referred as austenite temperature), and then iii) the above sheet is subject to phase transformation to ferrite (α) (hereafter referred as a γ→α transformation). After forming grains with {100} texture on the surface of the sheet, the grains should grow inward enough to have a grain size of at least half the thickness of the sheet to make major portion of the grains in the sheet to have {100} texture. In the present invention, the formation of {100} texture on surfaces of the sheet and the growth of {100} grains can be achieved simultaneously or separately and continuously.

Non-oriented electrical steels manufactured by the method disclosed by the present invention are composed of Fe or Fe—Si alloys with columnar grains, having at least 25% of the surface area covered by grains with {100} texture. If the heat treatment conditions are strictly controlled, all the surfaces of the sheet could be covered by grains with {100} texture.

Method of Forming Texture on the Surface

According to the present invention, a method of forming a surface texture includes a step of heat treatment and a step of phase transformation. The above surface texture includes {100} and {111}. Also, the above method of forming surface texture is applicable to Fe or Fe-base alloys. The heat treatment should be conducted at a temperature range where an austenite phase is stable. Since austenite temperature is determined by chemical composition of given alloy systems, the heat treatment temperature should be defined differently depending on chemical composition of alloys.

The formation of the surface texture is accomplished by the γ→α transformation. During the γ→α transformation, an extensive rearrangement of the atomic structure occurs. The γ→α transformation can be induced by varying temperature (cooling), composition, or temperature and composition. The γ→α transformation can be induced by varying composition of the sheet due to a chemical reaction between alloying elements and annealing atmosphere or due to evaporation of alloying elements. The formation of surface texture seems to be closely related to the γ→α transformation. Thus, cooling rate should be controlled precisely in order to obtain the intended surface texture.

According to the present invention, the γ→α transformation can be utilized as a tool to rearrange surface atoms to have a specific texture. Phase transformations that occur at the recrystallization temperature may have a profound effect on atomic rearrangement. This is because the energy change associate with the γ→α phase transformation (approximately 1000 J/mole) is much larger than the energy change associated with dislocation density or grain boundary area. Although it is well known that there is a crystallographic orientation relationship between austenite and ferrite (for example, Krudjumow-Sachs relationship), texture is rather randomized after the γ→α transformation because 24 variants act with equal possibility. In the present invention, a method of extensively rearranging atomic structure on a surface of the sheet is disclosed utilizing the γ→α transformation under a specific atmosphere.

Method of Forming {100} Texture on the Surface

A method of the present invention to form {100} texture on the surface comprises a step of heat treatment under a controlled atmosphere. Among the important variables of the heat treatment such as heating rate, soaking temperature, soaking time, cooling rate, and gas atmosphere, the most important variable is a level of oxygen in the annealing atmosphere.

To achieve high density {100} texture, the level of oxygen in the annealing atmosphere should be low enough so as not to oxidize surfaces of the sheet. The method of forming {100} texture on surfaces of the sheet is applicable to Fe or Fe-base alloys consisting essentially of Si, Mn, Ni, C, Al, Cu, Cr, and P. The alloying elements described above do not impede effects of the present invention, and furthermore, they can be used to reduce the detrimental effect of oxygen on the formation of {100} texture, which will be described later.

The heat treatment should be conducted at the temperature range where the austenite phase is stable. Since austenite temperature is a function of chemical composition of given alloy systems, the heat treatment temperature should be determined differently as chemical composition of the surface varies. By doping austenite stabilizing elements such as Mn, Ni, and C, the heat treatment temperature can be lowered, and thereby efficiency of the process can be enhanced.

According to the present invention, the γ→α transformation can be utilized as a tool to rearrange surface atoms to have {100} texture. The γ→α transformation can be induced by varying temperature (cooling), composition, or temperature and composition. During heat treatments, the variation in composition of the sheet can occur due to a chemical reaction between alloying elements and the annealing atmosphere or due to evaporation of an austenite stabilizing elements such as manganese. The formation of {100} surface texture seems to be closely related to the $\gamma \rightarrow \alpha$ transformation. So, cooling rate during the $\gamma \rightarrow \alpha$ transformation should be controlled precisely in order to obtain a high density {100} texture on surfaces of the sheet.

The method of the present invention to form {100} texture on surfaces of the sheet comprises a step of a heat treatment under a vacuum or a controlled atmosphere. Also, oxygen content of Fe or Fe-base alloys should be less than 40 ppm to minimize the detrimental effect of oxygen on the formation of {100} texture. When a heat treatment is conducted under a vacuum condition, the vacuum pressure should be preferably less than $1\times10^{-3}$ torr and more preferably, less than $1\times10^{-5}$ torr. The reason to have such a low vacuum pressure is to keep oxygen partial pressure low in the annealing atmosphere.

In the present invention, if the partial pressure of oxygen is high, the formation of {100} surface texture is hampered. Heat treatments can be preferably performed in an atmosphere in which a reducing gas ($H_2$, or hydrocarbon gases), an inert gas (He, Ne, or Ar), or a mixture gas of both is the major component. In a reducing gas atmosphere, oxygen atoms on surfaces of the sheet could be removed by chemical reactions to form $H_2O$ or CO.

In reducing gas atmospheres, though there is no limitation in gas pressure, preferably the gas pressure of 1 atm can be used and more preferably a pressure range of $10^{-1}$ to $10^{-5}$ atm can be used. Also, a dew point of annealing atmospheres should be controlled so as not to form any kind of oxide on surfaces of the sheet before and during heat treatments at austenite temperature. This is because water vapor in a reducing gas atmosphere or an inert gas atmosphere can act as a source of oxygen.

According to the present invention, oxygen content in Fe and Fe-base alloys is an important variable in forming {100} texture by the $\gamma \rightarrow \alpha$ transformation. The amount of interstitial oxygen in Fe and Fe-base alloys should be controlled to be below a certain level. If the oxygen content is high, it would hamper the formation of {100} texture.

Also, it is recommended to remove any form of oxides on surfaces of the sheet utilizing a pickling process before the {100} forming heat treatment.

In order to purify annealing atmosphere, extra steps of removing oxygen and/or water vapor in a gas atmosphere can be included before and during the {100} forming heat treatment, Oxygen and water vapor in gas atmospheres can be removed utilizing various kinds of absorbents.

The detrimental effect of oxygen on forming {100} texture on surfaces of the sheet can also be lessened by alloying or coating certain elements such as carbon and manganese. Carbon atoms can remove oxygen on surfaces of the sheet to form carbon monoxide gas. In the case of manganese, since the vapor pressure of manganese is so high at annealing temperature, manganese atoms evaporated from the surfaces of the sheet seems to block oxygen molecules in gas atmosphere so as not to collide with surfaces of the sheet during annealing. In the case of alloying the above elements, carbon content is less than 0.5% and manganese content is less than 3.0%. Coating of these elements on surfaces of the sheet has the same beneficial effects on the formation of {100} texture. Also, coating of iron, nickel, and copper, which are less reactive elements to oxygen than silicon steels, lessens the detrimental effect of oxygen on forming {100} texture. These elements not only protect the surface from an oxygen containing atmosphere, but also stabilize the austenite phase, thereby lowering the heat treatment temperature.

The method of the present invention to form {100} texture on surfaces of the sheet comprises a step of cooling from austenite to ferrite. Since the formation of {100} texture is closely related to the $\gamma \rightarrow \alpha$ transformation, a cooling rate during the transformation plays an important role in forming {100} texture. During the $\gamma \rightarrow \alpha$ transformation, it is preferable to have a cooling rate of less than 3000° C./hr.

By controlling the cooling rate, formation of {100} texture can be enhanced and formation of {111} can be suppressed. When the $\gamma \rightarrow \alpha$ transformation is induced by cooling, the optimum cooling rate varies depending on chemical composition of the sheet and soaking temperature. For example, in Fe—Si alloys, the optimum cooling rate is 50 to 1000° C./hr. However, in Fe—Si alloys with soaking temperature higher than 1100° C., a high density {100} texture is formed even at a cooling rate of more than 3000° C./hr. Also, in Fe—Si—C alloys, where carbon content is 0.03 to 0.5%, the optimum cooling rate is higher than 600° C./r. In Fe—Si—Mn alloys, where manganese content is 0.1 to 3.0%, the optimum cooling rate is lower than 100° C./hr. Soaking time also affects the formation of {100} texture. The optimum soaking time for the formation of {100} texture is 1 to 60 minutes, and not longer than 120 minutes.

In the present invention, surface roughness ($R_a$) of the sheet is closely related to the formation of the {100} texture. To form a high density {100} texture, it is preferable to have a surface roughness of less than 0.1 μm. Therefore, it is necessary to have a smooth surface before {100} forming heat treatment.

By adopting the method of the present invention, the formation of highly aggregated {100} texture on surfaces of the sheet can be achieved within 30 minutes or less and preferably within a few minutes. Since the annealing time is short, a continuous annealing, which is more suitable for mass production, can be adopted.

In this invention, texture coefficient, $P_{hkl}$, is used to evaluate texture formation. $P_{hkl}$ is defined as follows, $$P_{hkl} = \frac{\sum N_{hkl}}{\sum\left(N_{hkl}\frac{I_{hkl}}{I_{R,hkl}}\right)} \times \left(\frac{I_{hkl}}{I_{R,hkl}}\right), \text{ where}$$

$N_{hkl}$: multiplicity factor, $I_{hkl}$: X-ray intensity of (hkl) plane for a given sample, $I_{R,hkl}$: X-ray intensity of (hkl) plane for a specimen with randomly oriented grains.

$P_{hkl}$ represents an approximate ratio of the surface area covered by (hkl) plane in the sample of interest to that in a sample with randomly oriented grains.

The present invention can be generally and fundamentally applied to Fe and Fe-base alloys. The general application of the present invention to typical Fe-base alloys is listed below. Detailed technical information about each alloy system can be found in the examples. The chemical composition of the alloys only includes the alloying elements doped intentionally and unavoidable impurities are disregarded.

(1) Fe—Si

In Fe—Si alloys with Si content of less than 1.5%, to form a high density {100} texture, heat treatments should be conducted under the following conditions; temperature range of heat treatment: 910 to 1250° C. where austenite is stable, and heat treatment atmosphere: i) a vacuum atmosphere of less than $1\times10^{-5}$ torr or ii) a reducing gas atmosphere with pressure level of 1 atm or less. After the heat treatment at austenite temperature, Fe—Si alloys should experience the γ→α transformation by cooling.

(2) Fe—Si—C

In Fe—Si—C alloys with Si content of 2.0 to 3.5% and C content of less than 0.5%, to form a high density {100} texture, heat treatments should be conducted under the following conditions; temperature range of heat treatment: 800 to 1250° C. where austenite is stable, and heat treatment atmosphere: i) a vacuum atmosphere of less than $1\times10^{-3}$ torr or ii) a reducing gas atmosphere with pressure level of 1 atm or less. After the heat treatment at austenite temperature, Fe—Si—C alloys should experience the γ→α transformation by cooling or by varying chemical composition (decarburization).

(3) Fe—Si—Mn

In Fe—Si—Mn alloys with Si content of 1.0 to 3.5% and Mn content of less than 1.5%, to form a high density {100} texture, heat treatments should be conducted under the following conditions; temperature range of heat treatment: 800 to 1250° C. where austenite is stable, and heat treatment atmosphere: i) a vacuum atmosphere of less than $1\times10^{-3}$ torr or ii) a reducing gas atmosphere with pressure level of 1 atm or less. After the heat treatment at austenite temperature, Fe—Si—Mn alloys should experience the γ→α transformation by cooling or by varying chemical composition (removal of manganese atoms on surfaces of the sheet by evaporation, hereafter referred as demanganization).

(4) Fe—Si—Mn—C

In Fe—Si—Mn—C alloys with Si content of 1.0 to 3.5%, Mn content of less than 1.5%, and C content of less than 0.5%, to form a high density {100} texture, heat treatments should be conducted under the following conditions; temperature range of heat treatment: 800 to 1250° C. where austenite is stable, and heat treatment atmosphere: i) a vacuum atmosphere of less than $1\times10^{-3}$ torr or ii) a reducing gas atmosphere with pressure level of 1 atm or less. After the heat treatment at austenite temperature, Fe—Si—Mn—C alloys should experience the γ→α transformation by cooling or by varying chemical composition (decarburization and/or demanganization).

(5) Fe—Si—Ni

In Fe—Si—Ni alloys with Si content of 1.0 to 4.5%, Ni content of less than 3.0%, to form a high density {100} texture, heat treatments should be conducted under the following conditions; temperature range of heat treatment: 800 to 1250° C. where austenite is stable, and heat treatment atmosphere: i) a vacuum atmosphere of less than $1\times10^{-5}$ torr or ii) a reducing gas atmosphere with pressure level of 1 atm or less. After the heat treatment at austenite temperature, Fe—Si—Ni alloys should experience the γ→α transformation by cooling.

EXAMPLES

Table 1 shows the chemical composition of the alloys used in the present invention. Unless otherwise stated, all statement of percentages means percentage by weight. Ingots having the chemical composition shown in Table 1 were prepared by vacuum induction melting. These ingots were hot-forged to 20 mm thick plates. These steel plates were hot-rolled to have a thickness of 2 mm. After the hot rolling process, surface scale was removed utilizing a pickling process in 18% HCl at 60° C. These plates were cold-rolled to a sheet with various thicknesses such as 0.3 mm, 0.5 mm, and the like. The alloying elements with trivial amounts were not intentionally doped unless otherwise stated, and they are inevitable impurities. Such small amounts of impurities do not have a significant effect on the formation of {100} texture.

TABLE 1

| Alloys | Fe | Si | Mn | Al | C | Ni | S |
|---|---|---|---|---|---|---|---|
| Pure Iron 1 | bal | <0.001 | <0.001 | 0.001 | 0.0013 | 0.007 | 0.0007 |
| Pure Iron 2 | bal | 0.001 | 0.001 | | 0.024 | | 0.0012 |
| Fe—1.0%Si | bal | 0.97 | | 0.0016 | 0.0024 | 0.0041 | 0.0013 |
| Fe—1.0%Si—0.05%C | bal | 0.96 | | 0.0019 | 0.045 | 0.0041 | 0.0013 |
| Fe—1.0%Si—0.1%C | bal | 1.00 | | 0.0016 | 0.098 | 0.0040 | 0.0015 |
| Fe—1.5%Si | bal | 1.48 | | 0.0024 | 0.0050 | 0.0041 | 0.0020 |
| Fe—1.5%Si—0.05%C | bal | 1.49 | | 0.0025 | 0.047 | 0.0042 | 0.0015 |
| Fe—1.5%Si—0.1%C | bal | 1.50 | | 0.0024 | 0.10 | 0.0043 | 0.0018 |
| Fe—2.0%Si | bal | 2.07 | | 0.0012 | 0.0034 | 0.0030 | 0.0016 |
| Fe—2.5%Si | bal | 2.56 | | 0.0038 | 0.0038 | 0.0031 | 0.0016 |
| Fe—2.5%Si—0.3%C | bal | 2.56 | | 0.0015 | 0.28 | 0.0023 | 0.0017 |
| Fe—3.0%Si | bal | 2.99 | | 0.0016 | 0.0026 | 0.0031 | 0.0013 |
| Fe—3.0%Si—0.1%C | bal | 3.02 | | 0.0039 | 0.064 | 0.0072 | 0.0015 |
| Fe—3.0%Si—0.2%C | bal | 3.00 | | 0.0014 | 0.19 | 0.0034 | 0.0019 |
| Fe—3.0%Si—0.3%C | bal | 3.05 | | 0.0028 | 0.28 | 0.0012 | 0.0020 |
| Fe—0.4%Si—0.3%Mn | bal | 0.40 | 0.27 | | 0.0054 | 0.0071 | 0.0051 |
| Fe—1.0%Si—1.5%Mn | bal | 0.97 | 1.49 | 0.0020 | 0.0024 | 0.0056 | 0.0017 |
| Fe—1.5%Si—1.5%Mn | bal | 1.48 | 1.53 | 0.0024 | 0.0034 | 0.0056 | 0.0018 |
| Fe—2.0%Si—1.0%Mn | bal | 1.98 | 0.99 | 0.0014 | 0.0025 | 0.0029 | 0.0016 |
| Fe—2.0%Si—1.0%Mn—0.05%C | bal | 2.04 | 1.01 | 0.0013 | 0.045 | 0.0030 | 0.0018 |
| Fe—2.0%Si—1.0%Mn—0.1%C | bal | 2.02 | 0.99 | 0.0016 | 0.095 | 0.0029 | 0.0016 |
| Fe—2.0%Si—1.0%Mn—0.2%C | bal | 2.07 | 1.00 | 0.0011 | 0.19 | 0.0030 | 0.0020 |
| Fe—2.5%Si—1.5%Mn | bal | 2.51 | 1.41 | 0.0012 | 0.0030 | 0.0028 | 0.0016 |
| Fe—2.5%Si—1.5%Mn—0.2%C | bal | 2.52 | 1.47 | 0.0017 | 0.19 | 0.0028 | 0.0020 |
| Fe—2.0%Si—1.0%Ni | bal | 1.98 | | 0.0016 | 0.0045 | 1.02 | 0.0017 |

Example 1

FIG. 1 shows that when pure iron 1 is annealed at austenite temperature while minimizing an effect of oxygen in the sheet or in a heat treatment atmosphere, and then when the above sheet is subject to the γ→α transformation, the resulting sheet has a high proportion of {100} texture. Heat treatments were performed in a reducing gas atmosphere (1 atm $H_2$ gas having dew point of −54° C.). When temperature of a furnace reached 850° C., samples were placed in the middle of the furnace. After holding at 850° C. for 5 minutes, samples were heated to soaking temperature with heating rate of 600° C./hr. After holding for 1 minute at the soaking temperature, samples were cooled to 850° C. with cooling rate of 600° C./hr. At the conclusion of the heat treatment, samples were pulled out from the furnace and cooled in a chamber at room temperature.

When iron samples are annealed at the temperature below 910° C., where ferrite is stable, formation of {111} texture is dominant. This is a typical behavior of a steel sheet. However, when samples were annealed at the temperature over 910° C., where austenite is stable, the resulting sheet has a high proportion of {100} texture (more than 60% of the surface area is covered with {100} texture) and almost all the {111} texture disappears. The formation of high density {100} texture in pure iron with sulfur level of 7 ppm, is rather exceptional. Furthermore, to form {100} texture, 930° C. is sufficient and time for the heat treatment is less than 20 minutes. In a steel sheet with commercial purity, this behavior has not been observed before. This result suggests that the formation of high density {100} texture by the $\gamma \rightarrow \alpha$ transformation in a reducing gas atmosphere (in a heat treatment atmosphere of minimizing the effect of oxygen) is an inherent property of pure iron.

Figure 2:
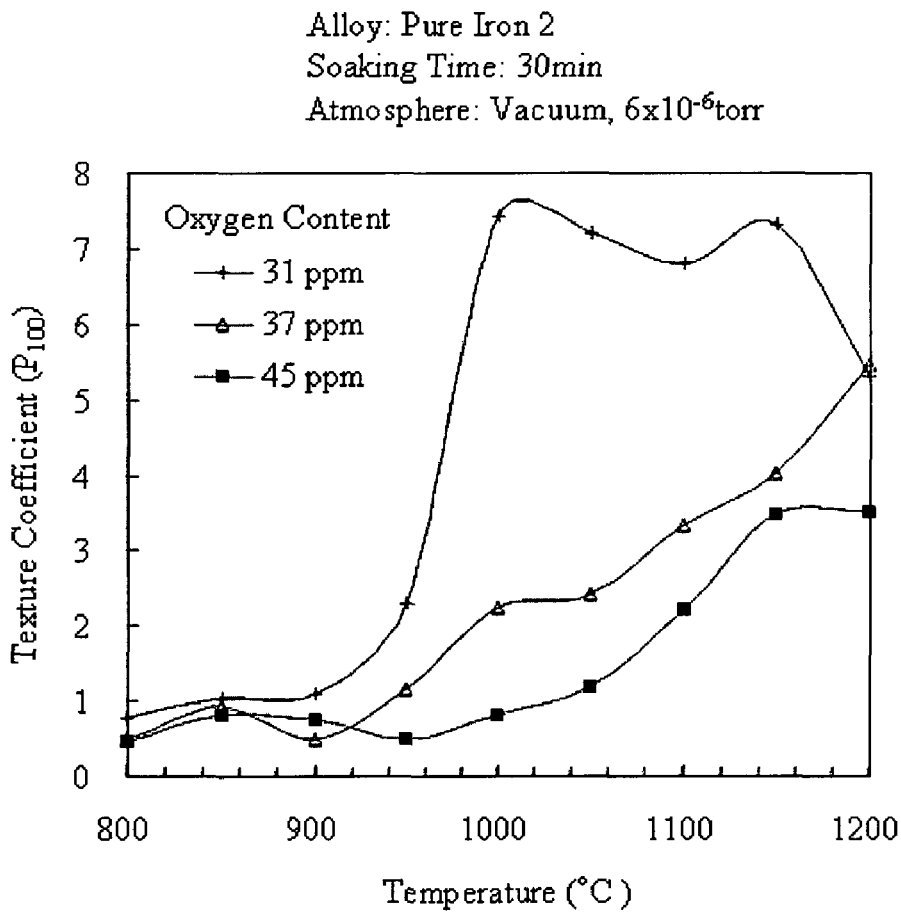
FIG. 2 is a graph showing an effect of oxygen in solution on the formation of {100} texture, which was developed by annealing in a vacuum atmosphere of $6\times10^{-6}$ torr for pure iron 2.

Oxygen content in iron has a significant effect on the formation of {100} texture (FIG. 2). Heat treatments were performed in a vacuum atmosphere ($6\times10^{-6}$ torr). When temperature of the furnace reached the soaking temperature, samples were placed in the middle of the furnace. After holding for 30 minutes at the soaking temperature, samples were pulled out from the furnace and cooled in the chamber at room temperature. After heat treatment below 910° C., no significant strengthening of {100} plane is observed ($P_{100}$=approximately 1). However, when samples are annealed at the temperature over 910° C., oxygen content in iron affects the formation of {100} texture significantly. When oxygen level is low such as 31 ppm, high density {100} texture is observed at 1000° C., whereas in the same heat treatment with 45 ppm oxygen, there is no strengthening of {100} texture. This result suggests that oxygen in iron hampers the formation of high density {100} texture by the $\gamma \rightarrow \alpha$ transformation and oxygen content in iron should be controlled to be less than 40 ppm to form {100} texture.

Figure 3:
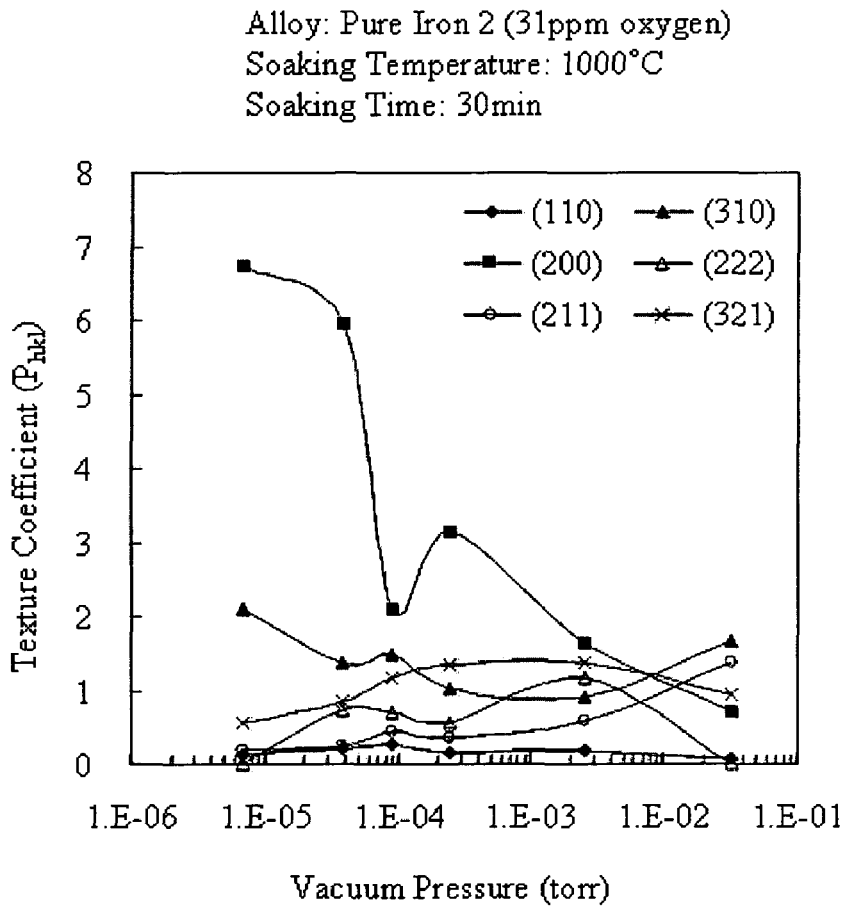
FIG. 3 is a graph showing an effect of vacuum pressure on the formation of {100} texture, which was developed by annealing at 1000° C. for 30 minutes for pure iron 2.

Oxygen in annealing atmospheres also has a profound effect on the formation of {100} texture (FIG. 3). Heat treatments of iron with oxygen level of 31 ppm were performed in the vacuum furnace at various vacuum pressures. When the temperature of the furnace reached 1000° C., samples were placed in the middle of the furnace. After holding for 30 minutes at 1000° C., samples were pulled out from the furnace and cooled in the chamber at room temperature. The results show that enhancement of {100} texture is observed below a pressure level of $1\times10^{-4}$ torr. Furthermore, as the vacuum pressure becomes lower, {100} texture becomes stronger. Since the vacuum pressure is proportional to the oxygen partial pressure in the vacuum system, the above result can be interpreted as a detrimental effect of oxygen in annealing atmospheres on the formation of {100} texture.

From the above results, we can conclude that when iron is annealed at austenite temperature while minimizing an effect of oxygen in the sheet or in a heat treatment atmosphere, and subsequently when the above sheet is subject to the $\gamma \rightarrow \alpha$ transformation, the resulting sheet has a high proportion of {100} texture. Furthermore, the present invention discloses a fast and efficient method of forming {100} texture. Even within 5 minutes of heat treatments, a high density {100} texture can be developed on surfaces of the sheet.

Example 2

Figure 4:
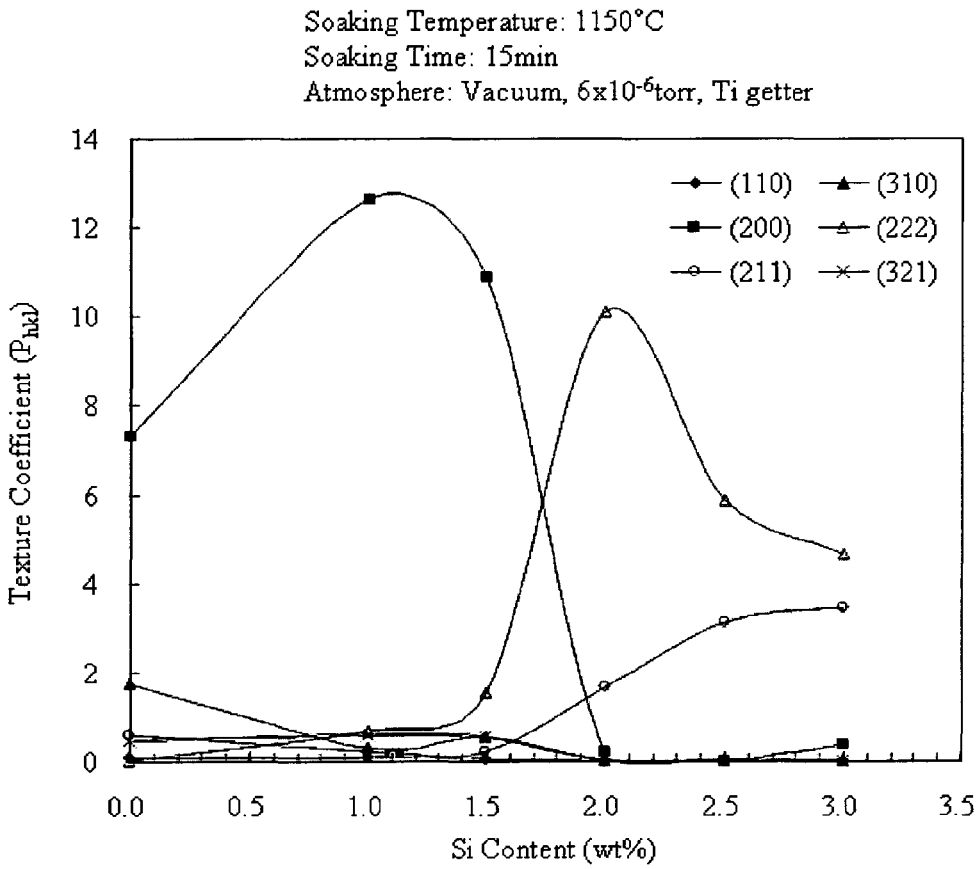
FIG. 4 is a graph showing an effect of silicon content on the formation of {100} texture, which was developed by annealing in a vacuum atmosphere of $6\times10^{-6}$ torr with Ti getter.

FIG. 4 shows that when Fe—Si alloys were annealed at austenite temperature while minimizing an effect of oxygen in a heat treatment atmosphere, and subsequently when the above sheet is subject to the $\gamma \rightarrow \alpha$ transformation, the resulting sheet has a high proportion of {100} texture. Heat treatments were performed in a vacuum atmosphere ($6\times10^{-6}$ torr with Ti getter). In these heat treatments, a pure titanium plate was located next to the sample as an oxygen getter to remove oxygen in the vacuum atmosphere. When the temperature of the furnace reached 1150° C., samples were placed in the middle of the furnace. After holding for 15 minutes at 1150° C., samples were pulled out from the furnace and cooled in the chamber at room temperature. At 1150° C., austenite is a stable phase for alloys with Si content of 0, 1.0, and 1.5%, whereas ferrite is a stable phase for alloys with Si content of 2.0, 2.5, and 3.0%.

As shown in FIG. 4, well developed {100} texture is observed in Fe—Si alloys which experience the $\gamma \rightarrow \alpha$ transformation during cooling. However, without experiencing the $\gamma \rightarrow \alpha$ transformation) the intensity of {100} texture is less than 1 (randomly oriented sample), and {111} and {211} planes are dominant. From these results, we can conclude that, the method of forming high density {100} texture by the $\gamma \rightarrow \alpha$ transformation in an oxygen deficient atmosphere is also applicable to Fe—Si binary alloy systems. Since silicon is a major alloying element in Fe-base soft magnetic materials, this conclusion is remarkably meaningful. Furthermore, the formation of {100} texture seems to be much easier in Fe—Si alloys than in iron. This result might be interpreted as an oxygen scavenging effect of silicon. As shown in example 1, oxygen in Fe hampers the formation of a high density {100} texture by the $\gamma \rightarrow \alpha$ transformation. However, if silicon, which has a higher affinity to oxygen than iron, is a major alloying element, silicon will react with interstitial oxygen atoms in Fe-base alloys and thereby the amount of interstitial oxygen atoms, which appear to hinder the Fe-base alloys from forming {100} texture, would be low (oxygen scavenging effect). Thus, the formation of {100} texture seems to be much easier in Fe—Si alloys than in Fe.

Figure 5:
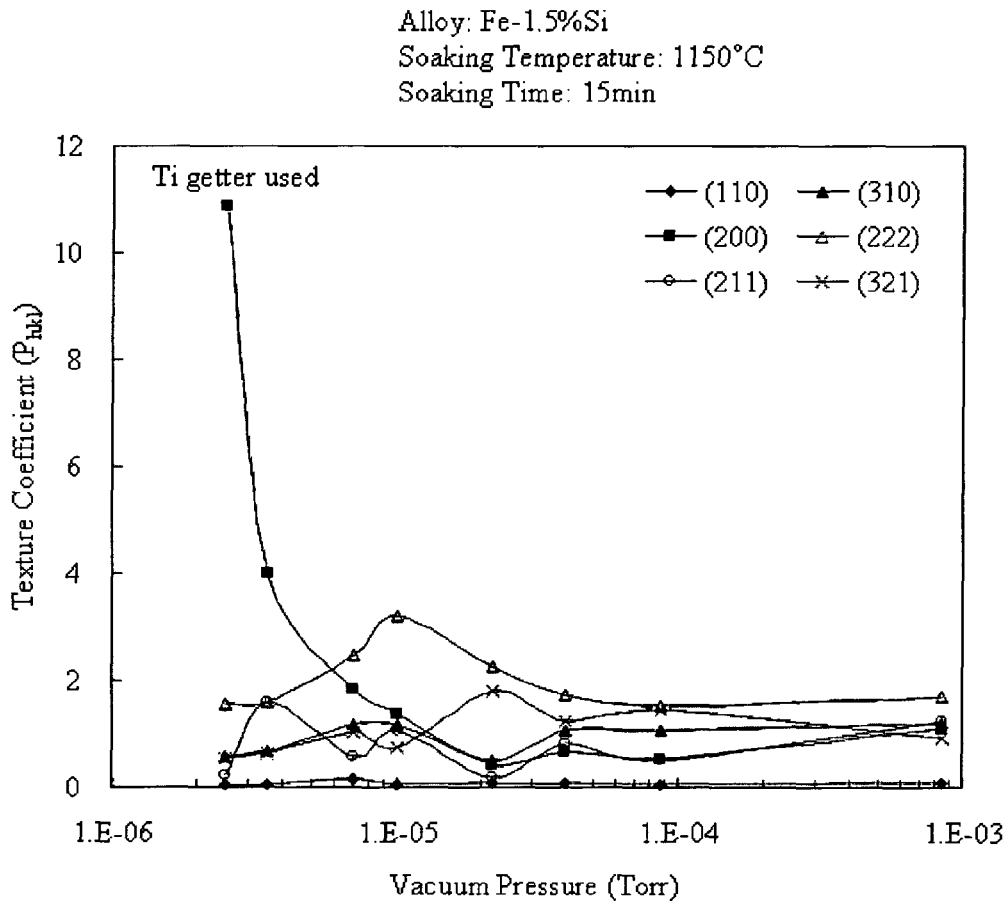
FIG. 5 is a graph showing an effect of vacuum pressure on the formation of {100} texture, which was developed by annealing at 1150° C. for 15 minutes for Fe-1.5% Si.

By the same reason, Fe—Si alloys should be heat-treated under a more severe oxygen deficient atmosphere. Heat treatments of Fe-1.5% Si were performed in the vacuum furnace at various vacuum levels. When the temperature of the furnace reached 1150° C., samples were placed in the middle of the furnace. After holding for 15 minutes at 1150° C., samples were pulled out from the furnace and cooled in the chamber at room temperature. Different from iron, enhancement of {100} texture is observed at lower vacuum level, below $1\times10^{-5}$ torr (FIG. 5). As the vacuum pressure decreases more and more, such as $6\times10^{-6}$ torr or $3\times10^{-6}$ torr with Ti getter, the {100} texture becomes stronger. In this case, silicon in alloys seems to react with oxygen in the heat treatment atmosphere due to high oxygen affinity of silicon. Since oxygen on surfaces of the sheet (in the form of interstitial atoms or oxides) seems to prevent iron and iron-base alloys from forming {100} texture, the more high oxygen affinity elements in alloys, the more necessary it is to strictly control annealing atmosphere.

Example 3

Figure 6:
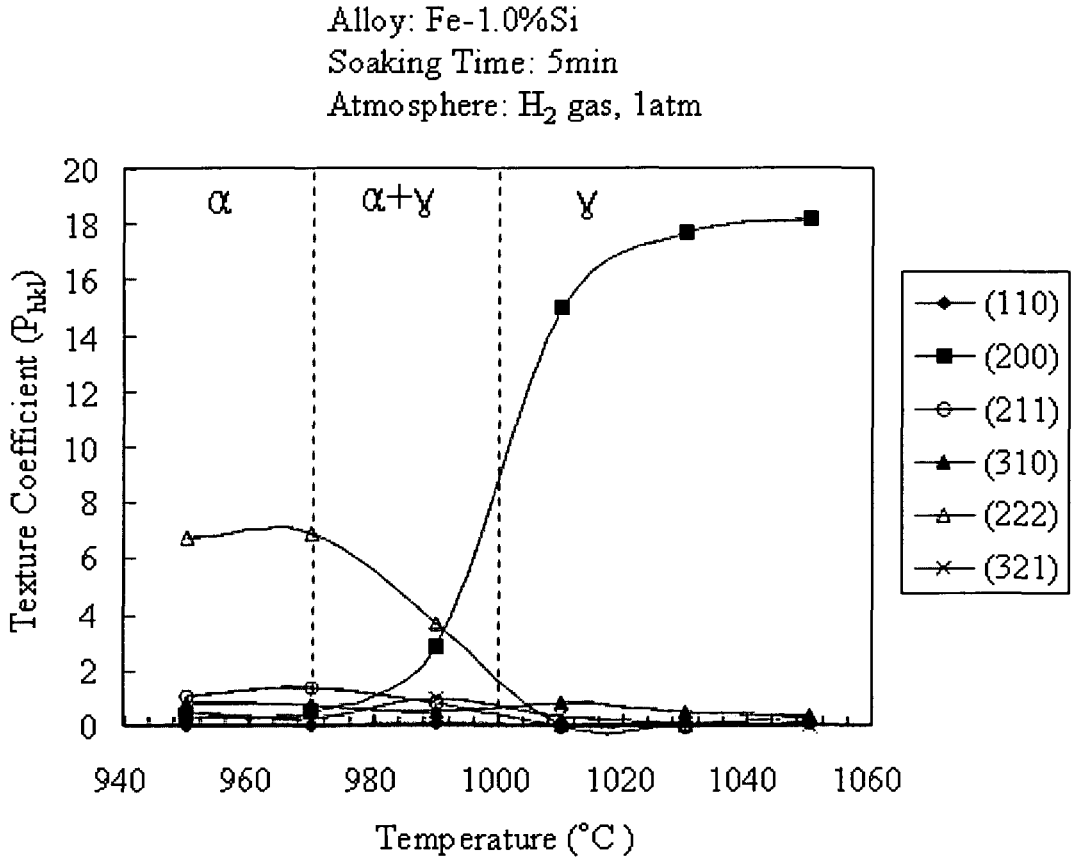
FIG. 6 is a graph showing an effect of annealing temperature on the formation of {100} texture, which was developed by annealing in 1 atm $H_2$ atmosphere for Fe-1.0% Si.

FIG. 6 shows that when a sheet of Fe-1.0% Si is annealed at the austenite temperature while minimizing an effect of oxygen in a heat treatment atmosphere, and subsequently when the above sheet is subject to the $\gamma \rightarrow \alpha$ transformation, the resulting sheet has a high proportion of {100} texture on surfaces of the sheet, Heat treatments were performed in a reducing gas atmosphere (1 atm $H_2$ gas having dew point of −55° C.). When the temperature of the furnace reached 950°

C., samples were placed in the middle of the furnace. After holding for 5 minutes at 950° C., samples were heated to a soaking temperature with heating rate of 600° C./hr. After holding for 5 minutes at the soaking temperature, samples were cooled to 950° C. with cooling rate of 600° C./hr. At the conclusion of the heat treatment, samples were pulled out from the furnace and cooled in the chamber at room temperature.

In a Fe-1% Si alloy system, austenite is a stable phase at the temperature range of 1000 to 1310° C., whereas ferrite is a stable phase below 970° C., and, ($\alpha+\gamma$) two phase field is 970 to 1000° C. When Fe-1.0% Si samples were annealed at the temperature below 970° C., where ferrite is stable, formation of {111} plane is dominant. This is a typical behavior of a silicon steel sheet. However, when samples were annealed at the temperature over 1000° C., where austenite is stable, the resulting sheet has a high proportion of {100} texture (more than 80% of the surface area is covered with {100} texture) and nearly all the {111} plane disappears.

From the above results, we can conclude that when Fe—Si alloy sheet is annealed at austenite temperature while minimizing an effect of oxygen in the sheet or in a heat treatment atmosphere, and subsequently when the above sheet is subject to the $\gamma\rightarrow\alpha$ transformation, the resulting sheet has a high proportion of {100} texture. Furthermore, the present invention discloses a fast and efficient method of forming {100} texture. Even within 5 minutes of heat treatments, high density {100} texture can be developed.

Example 4

Table 2 shows that in Fe-base alloys, a high proportion of {100} texture always develops after the $\gamma\rightarrow\alpha$ transformation in annealing atmosphere of minimizing an effect of oxygen. Heat treatments were performed in various vacuum atmospheres. In the heat treatment at the vacuum level of $6\times10^{-6}$ torr with Ti getter, a pure titanium plate was located next to the sample as an oxygen getter to remove oxygen in the vacuum atmosphere. In the heat treatment at the vacuum pressure of $4.1\times10^{-1}$ torr $H_2$, $H_2$ gas was supplied at the rate of 100 cc/min while the vacuum pressure was maintained using a rotary pump. When the temperature of the furnace reached the soaking temperature, samples were placed in the middle of the furnace. After holding for a desired time at the soaking temperature, samples were pulled out from the furnace and cooled in the chamber at room temperature (FC). In some cases, samples were furnace-cooled to ferrite temperature with a cooling rate of 400° C./hr and then samples were pulled out from the furnace and cooled in the chamber at room temperature.

In all the alloy system shown in Table 2 such as Fe—Si, Fe—Si—C, Fe—Si—Mn, Fe—Si—Mn—C, Fe—Si—Ni, and Fe—Si—Al, if the stable phase at soaking temperature is austenite and if annealing atmospheres are controlled to have a minimal amount of oxygen or preferably if it is an oxygen free atmosphere, a high proportion of {100} texture always develops.

Carbon doped Fe—Si alloys were tested because carbon is an austenite stabilizing element. Advantages of using carbon-doped alloys are decrease in soaking temperature due to a low $A_3$ temperature, and stabilization of austenite phase by carbon doping even in alloys without austenite phase field. In a Fe-3.0% Si system, without carbon, there is no austenite stable temperature. Thus, {100} texture cannot be developed. However, by doping 0.3% carbon, {100} texture is well developed by 1100° C. heat treatment. Also, since carbon decreases $A_3$ temperature of the given alloy system, soaking temperature can be decreased. As shown in Table 2, in Fe-1.5% Si alloy system, $A_3$ temperature decreases from 1080 to 970° C. as carbon level varies from 50 to 1000 ppm. When soaking temperature is 1050° C., {100} texture is well developed for Fe-1.5% Si-0.1% C whereas for Fe-1.5% Si, the development of {100} texture is not observed. Though carbon impairs magnetic properties of soft magnetic materials, it can be easily removed by a decarburization process. However, if too much carbon exists, poor workability and also complex phase formation such as several types of carbides would cause significant problems. Thus, the acceptable carbon content of Fe—Si alloys is less than 0.5%.

TABLE 2

| Chemical Composition (%) | $A_3$ Temp. (° C.) | Annealing Atmosphere | Heating Rate (° C./hr) | Soaking Temp. (° C.) | Soaking Time (min) | Stable Phase at Soaking Temp. | Cooling Rate (° C./hr) | Texture $P_{100}$ | Texture $P_{111}$ |
|---|---|---|---|---|---|---|---|---|---|
| Fe—1.5% | ~1080 | $6\times10^{-6}$ torr with Ti getter | FH* | 1050 | 10 | $\alpha$ | FC** | 0.83 | 5.55 |
| Fe—1.5%—0.05%C | ~1010 | $6\times10^{-6}$ torr with Ti getter | FH | 1050 | 10 | $\gamma$ | FC | 3.08 | 3.57 |
| Fe—1.5%—0.1%C | ~970 | $6\times10^{-6}$ torr with Ti getter | FH | 1050 | 10 | $\gamma$ | FC | 7.76 | 1.96 |
| Fe—3%Si | — | $6\times10^{-6}$ torr with Ti getter | FH | 1100 | 15 | $\alpha$ | FC | 0.13 | 10.41 |
| Fe—3%Si—0.3%C | ~970 | $6\times10^{-6}$ torr with Ti getter | FH | 1100 | 15 | $\gamma$ | FC | 6.74 | 1.79 |
| Fe—0.4%Si—0.3%Mn | ~930 | $6\times10^{-6}$ torr with Ti getter | FH | 1050 | 10 | $\gamma$ | FC | 3.77 | 1.95 |
| Fe—0.4%Si—0.3%Mn | ~930 | $6\times10^{-6}$ torr with Ti getter | FH | 900 | 10 | $\alpha$ | FC | 0.24 | 6.13 |
| Fe—1.0%Si—1.5%Mn | ~900 | $2\times10^{-5}$ torr | FH | 1000 | 15 | $\gamma$ | FC | 2.44 | 0.64 |
| Fe—1.0%Si—1.5%Mn | ~900 | $2\times10^{-5}$ torr | FH | 900 | 15 | $\alpha+\gamma$ | FC | 0.52 | 6.71 |
| Fe—2.0%Si—1.0%Mn—0.2%C | ~900 | $6\times10^{-6}$ torr with Ti getter | FH | 1100 | 10 | $\gamma$ | FC | 10.08 | 0.73 |
| Fe—2.0%Si—1.0%Mn—0.2%C | ~900 | $6\times10^{-6}$ torr with Ti getter | FH | 900 | 10 | $\alpha+\gamma$ | FC | 1.52 | 3.43 |
| Fe—2.0%Si—1.0%Ni | ~1065 | $4.1\times10^{-1}$ torr $H_2$ | FH | 1090 | 15 | $\gamma$ | 400 | 12.58 | 0.93 |
| Fe—2.0%Si—1.0%Ni | ~1065 | $4.1\times10^{-1}$ torr $H_2$ | FH | 1000 | 15 | $\alpha$ | 400 | 0.95 | 5.95 |
| Fe—1.0%Si—0.1%Al | ~1010 | $4.1\times10^{-1}$ torr $H_2$ | FH | 1050 | 10 | $\gamma$ | 400 | 6.65 | 1.23 |

*FH: fast heating of the sample at room temperature to soaking temperature

**FC: fast cooling of the sample at soaking temperature to room temperature

Mn doped Fe—Si alloys were tested because manganese is i) a common alloying element, which reduces eddy current loss and ii) an austenite stabilizing element. As shown in Table 2, manganese seems to weaken the formation of {100} texture and strengthen the formation of {310} texture instead. In alloy systems of Fe-0.4 Si-0.3% Mn and Fe-10.0% Si-1.5% Mn, after the $\gamma\rightarrow\alpha$ transformation, the formation of {100} texture is observed, but intensity of {100} texture is just 2 to 4 times higher than that of randomly oriented grains. Also, intensity of {310} plane is about 2 to 4 times higher than that of randomly oriented grains. Although these results suggest that manganese stabilizes {100} as well as {310} planes, in fact, formation of {310} plane is significantly affected by the cooling rate. In manganese containing Fe—Si alloys, grain growth behavior is completely different from that of Fe—Si alloys and this might affect the texture formation. A method of forming high density {100} texture in Fe—Si—Mn alloy systems will be disclosed later in this specification.

In Mn containing alloys, soaking temperature should be much higher than $A_3$ temperature (about 50 to 1000° C.). During heat treatment, manganese on the surface evaporates so fast that manganese level at the surface is much lower than that of the matrix. Since removal of manganese on the surface will increase $A_3$ temperature of surface area, and the formation of {100} texture starts at the surface of the sheet, soaking temperature should be much higher than $A_3$ temperature to keep the surface phase austenite. Since manganese has a beneficial effect on reducing core loss and $A_3$ temperature, it may not be contained.

Carbon and manganese doped Fe—Si alloys were tested to observe a synergistic behavior of two austenite stabilizing elements. In Fe-2.0% Si-1.0% Mn-0.2% C alloy, {100} texture is well developed by 1100° C. heat treatment. This result suggests that by doping carbon in Fe—Si—Mn alloys, weakening of {100} texture can be overcome. In manganese and carbon containing Fe—Si alloys, due to manganese evaporation on the surface, soaking temperature should be higher than $A_3$ temperature (about 50 to 100° C.), also.

Ni containing Fe—Si alloys were tested mainly because nickel is an austenite stabilizing element. In addition to this, nickel is beneficial in many aspects; i) it is stable at soaking temperature (no significant evaporation occurs), ii) it reduces eddy current loss by increasing resistivity of Fe—Si alloys, and iii) it increases tensile strength of Fe—Si alloys. In Fe-2.0% Si-10% Ni alloy, {100} texture is well developed by 1090° C. heat treatment. Since nickel has a beneficial effect on reducing core loss and $A_3$ temperature, it may not be contained.

Al doped Fe—Si alloys were tested because aluminum is a common alloying element for reducing eddy current loss. As shown in Table 2, aluminum seems to weaken the formation of {100} texture. Without aluminum (Fe-1% Si), {100} texture coefficient is around 16, whereas it decreases to 6.65 simply by adding 0.1% aluminum (60% reduction). The detrimental effect of aluminum on forming {100} texture can be interpreted in terms of high affinity of aluminum to oxygen. Since aluminum readily reacts with oxygen, even if there is very small amount of oxygen in an annealing atmosphere, aluminum on surfaces of the sheet will react with oxygen molecules. Therefore, formation of {100} texture is weakened. In fact, color of surfaces of the sheet is always rather dull in aluminum containing alloys. So, the acceptable aluminum content of Fe—Si alloys is less than 0.3%.

Example 5

Although oxygen in annealing atmospheres has a significant effect on the formation of {100} texture, an acceptable oxygen partial pressure in annealing atmosphere varies depending on chemical composition of Fe—Si alloys. Heat treatments of Fe—Si—C, Fe—Si—Mn and Fe—Si—Mn—C alloys were performed in the vacuum furnace at various vacuum levels. When the temperature of the furnace reached a soaking temperature, samples were placed in the middle of the furnace. After holding at the soaking temperature for certain sufficient duration to completely transform all the grains to austenite, samples were pulled out from the furnace and cooled in the chamber at room temperature. During heat treatments, vacuum pressure was controlled using a needle valve. Leak gas was air, but sometimes, high purity Ar gas of 99.999% was used.

Figure 7:
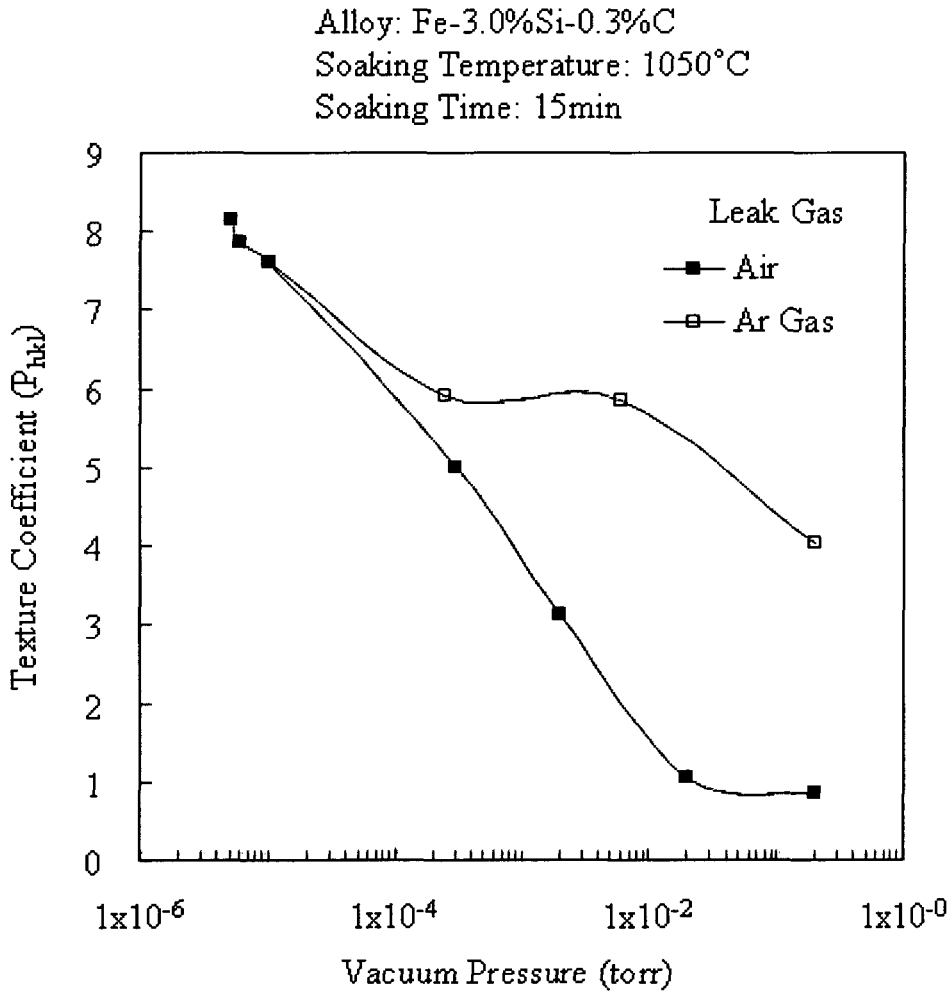
FIG. 7 is a graph showing an effect of leak gas on the formation of {100} texture, which was developed by annealing at 1050° C. for 15 minutes for Fe-3.0% Si-0.3% C.

In carbon containing alloys, carbon seems to attenuate the detrimental effect of oxygen on {100} texture formation. Carbon appears to play an important role in removing oxygen on surfaces of the sheet by reacting with oxygen to form carbon monoxide (CO). In Fe-3.0% Si-0.3% C, if the vacuum pressure was controlled using air, 100) texture can be developed at the vacuum pressure of less than $1\times10^{-3}$ torr, which is at least about 100 times higher vacuum pressure than that for Fe—Si alloys ($1\times10^{-5}$ torr) (FIG. 7). Furthermore, if the vacuum pressure was controlled using Ar gas instead of air, {100} texture can be developed at the vacuum pressure of $1\times10^{-1}$ torr or even higher. Theses results show that i) oxygen in annealing atmosphere hampers {100} texture formation, ii) thus, decrease of oxygen partial pressure in annealing atmospheres is a necessary condition for {100} texture formation, and iii) carbon in alloys plays an important role in removing oxygen on surfaces of the sheet.

Figure 8:
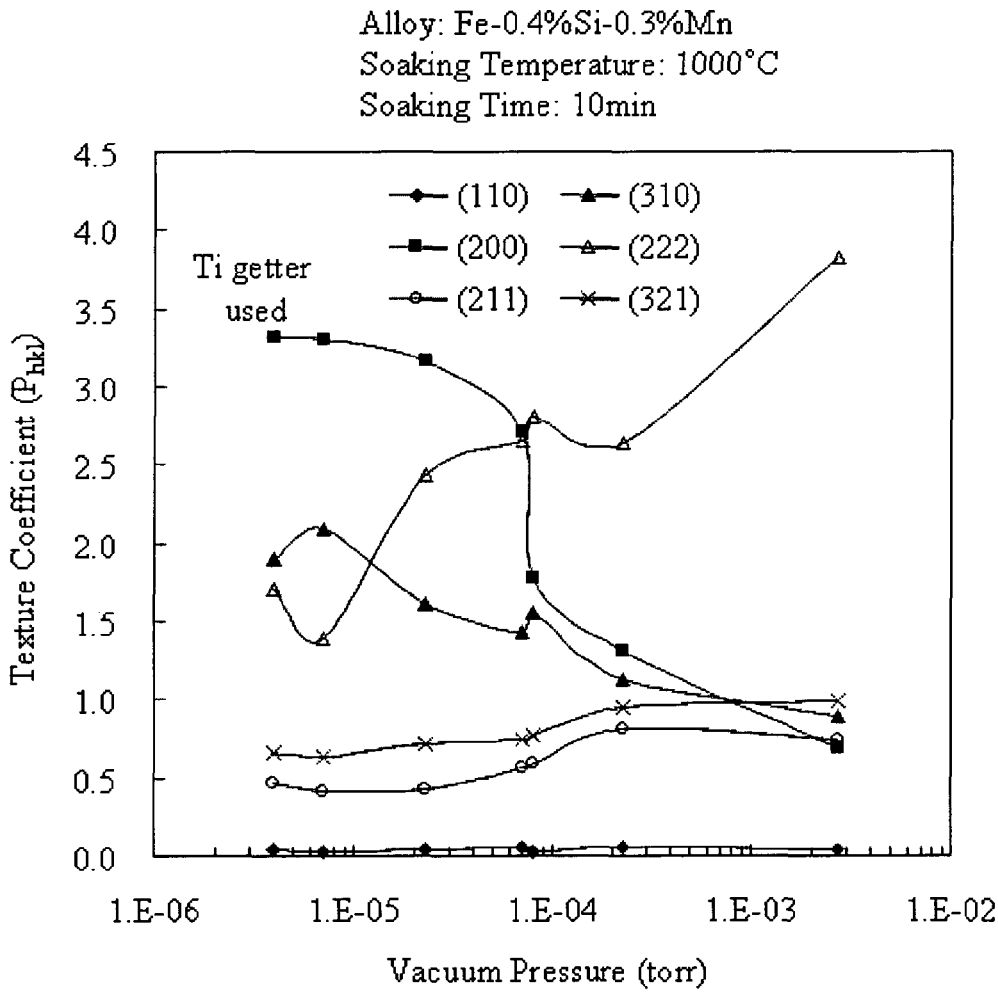
FIG. 8 is a graph showing an effect of vacuum pressure on the formation of {100} texture, which was developed by annealing at 1000° C. for 10 minutes for Fe-0.4% Si-0.3% Mn.

In manganese containing alloys, manganese seems to somewhat attenuate the detrimental effect of oxygen on {100} texture formation. Manganese atoms evaporated from surfaces of the sheet appears to block surfaces from oxygen molecules in annealing atmosphere. When a sheet of Fe-0.4% Si-0.3% Mn alloy is annealed at 1000° C. for 10 minutes, {100} texture develops at the vacuum pressure of less than $7\times10^{-5}$ torr, which is a vacuum pressure about 10 times higher than that for Fe—Si alloys ($1\times10^{-5}$ torr) (FIG. 8). But the vacuum pressure of $7\times10^{-5}$ torr does not really have any particular meaning. The limiting vacuum pressure varies depending on manganese content, soaking temperature, and soaking time. For example, if the soaking time of the above heat treatment is increased to 1 hour, {100} texture develops at the vacuum pressure of less than $2\times10^{-5}$ torr.

Figure 9:
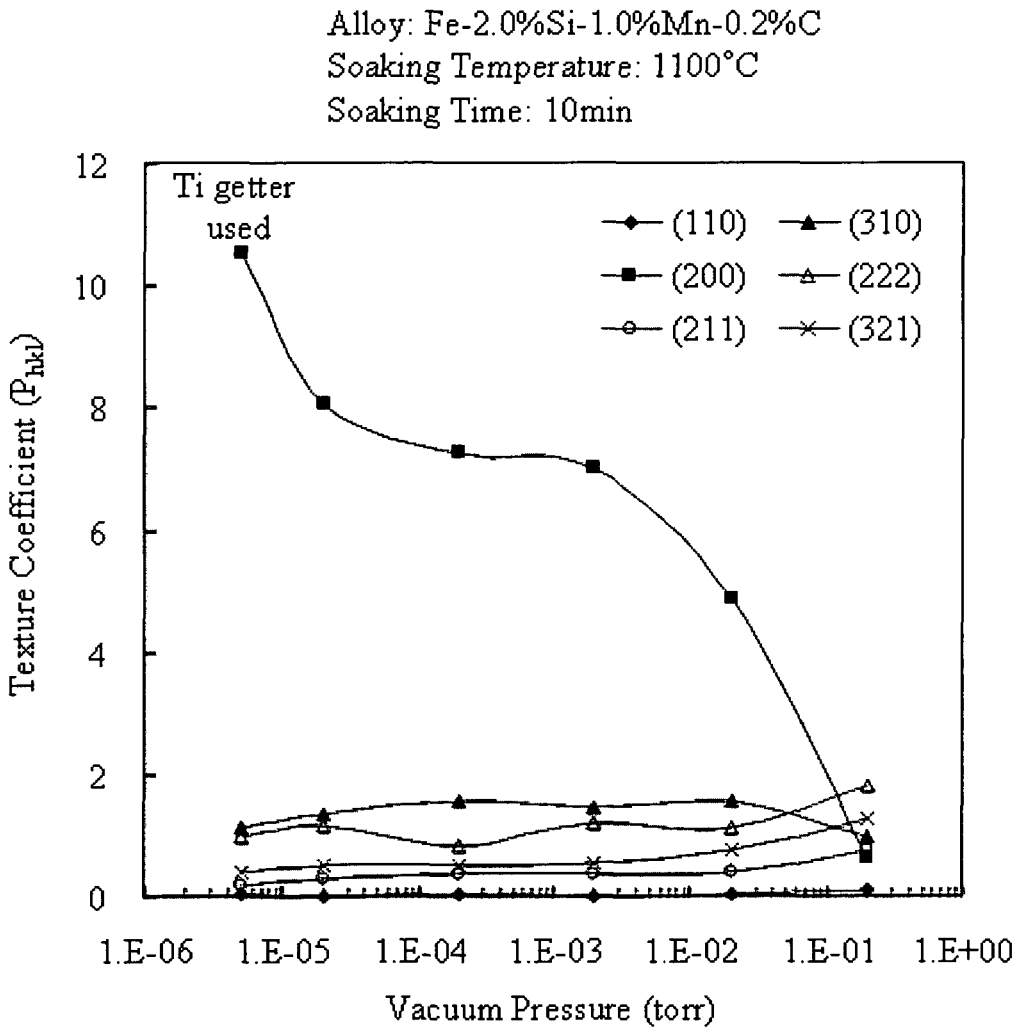
FIG. 9 is a graph showing an effect of vacuum pressure on the formation of {100} texture, which was developed by annealing at 1100° C. for 10 minutes for Fe-2.0% Si-1.0% Mn-0.2% C.

In carbon and manganese doped Fe—Si alloys, a synergistic effect of both elements is so great that {100} texture develops at the vacuum pressure of less than $1\times10^{-2}$ torr (FIG. 9). Furthermore, strengthening of {310} plane is not observed in this alloy system and thereby {100} texture is dominant.

From these results, we can conclude that annealing atmospheres and also alloy systems should be carefully selected to minimize an effect of oxygen on developing a high density {100} texture.

Example 6

Dew point control is a prime important factor to develop {100} texture in a $H_2$ gas atmosphere. As shown in FIG. 1 and FIG. 6, high proportion of {100} texture can be developed in a reducing gas atmosphere such as $H_2$ gas atmosphere. A potential advantage of using the reducing gas atmosphere is that oxygen on surfaces of the sheet can be removed by the reducing gas. However, since metals are oxidized at very low oxygen partial pressure at the temperature of interest, reducing gas should be carefully controlled so as not to oxidize surfaces of the sheet. Since so-called dry $H_2$ gas is thermodynamically a $H_2O$—$H_2$ gas mixture, during annealing, oxygen from $H_2O$ may affect surfaces of metals by establishing equilibrium among $H_2O$, $H_2$ and $O_2$. Therefore oxygen from $H_2O$ may hamper the formation of {100} texture.

Figure 10:
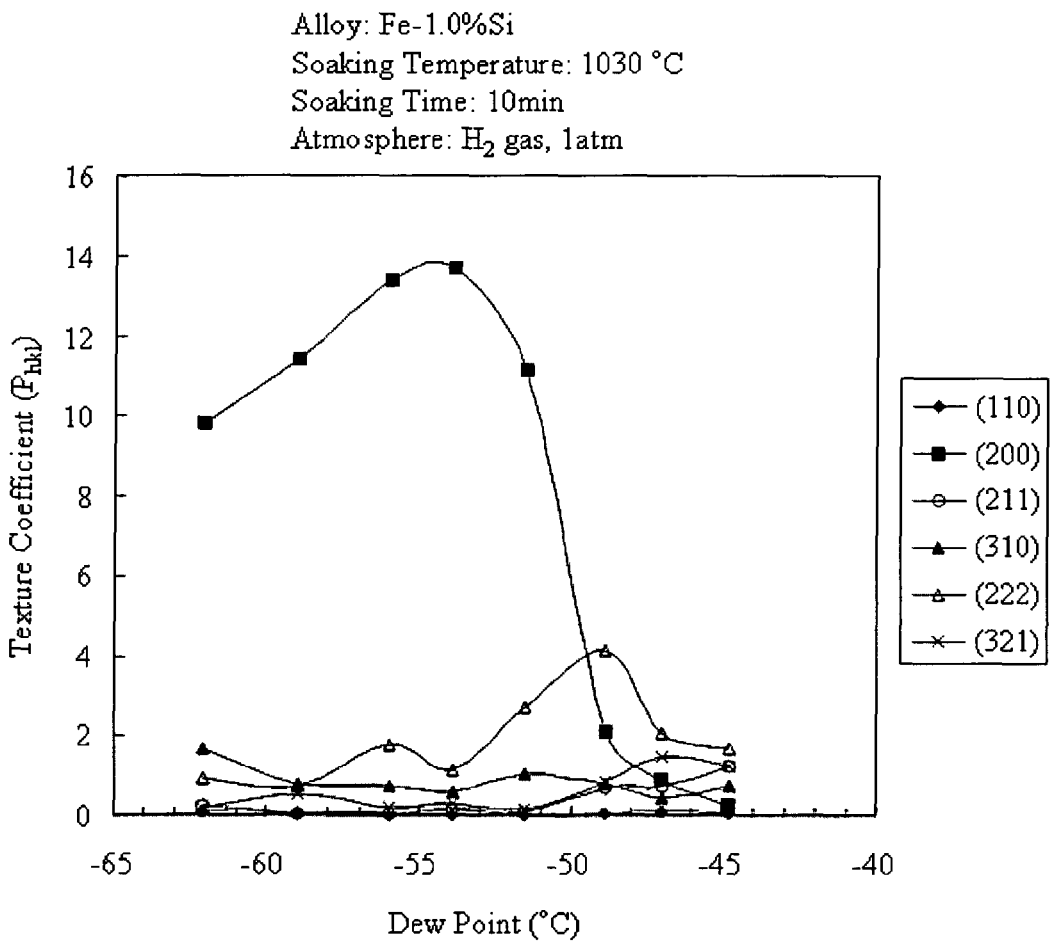
FIG. 10 is a graph showing an effect of dew point in annealing atmosphere on the formation of {100} texture, which was developed by annealing in 1 atm $H_2$ atmosphere for Fe-1.0% Si.

To determine the optimum dew point range for {100} texture formation in Fe-1% Si, heat treatments were performed in an atmosphere of 1 atm $H_2$ gas with various dew points. When temperature of the furnace reached 950° C., samples were placed in the middle of the furnace. After holding 5 minutes at 950° C., samples were heated to the soaking temperature of 1030° C., with heating rate of 600° C./hr. After holding for 10 minutes at the soaking temperature, samples were cooled to 950° C. with cooling rate of 600° C./hr. At the conclusion of the heat treatment, samples were pulled out from the furnace and cooled in the chamber at room temperature. FIG. 10 shows that when Fe—Si alloy sheet are annealed in 1 atm $H_2$ gas atmosphere with dew point of less than −50° C., the resulting sheet has a high proportion of {100} texture. Surprisingly, in Fe-1% Si alloy, oxidation ($SiO_2$) seems to begin at the dew point of about −50° C. at around the soaking temperature. These results suggest that dew point of annealing atmosphere should be selected so as not to oxidize surfaces of the given alloy system. Similar tests were conducted in Fe ($H_2$, 930° C. 5 minutes), Fe-1.5% Si ($H_2$, 1150° C. 15 minutes) and Fe-1.5% Si-0.1% C ($H_2$+50% Ar, 1150° C. 15 minutes). Critical dew points of each alloy system are −10° C., −50° C., and −45° C. In Fe-1.5% Si alloys, the critical dew point of carbon doped alloy is about 5° C. higher than that of the low carbon alloy. In carbon containing alloys (0.1% C), carbon appears to play an important role in removing oxygen on surfaces of the sheet by reacting with oxygen to form carbon monoxide (CO).

Figure 11:
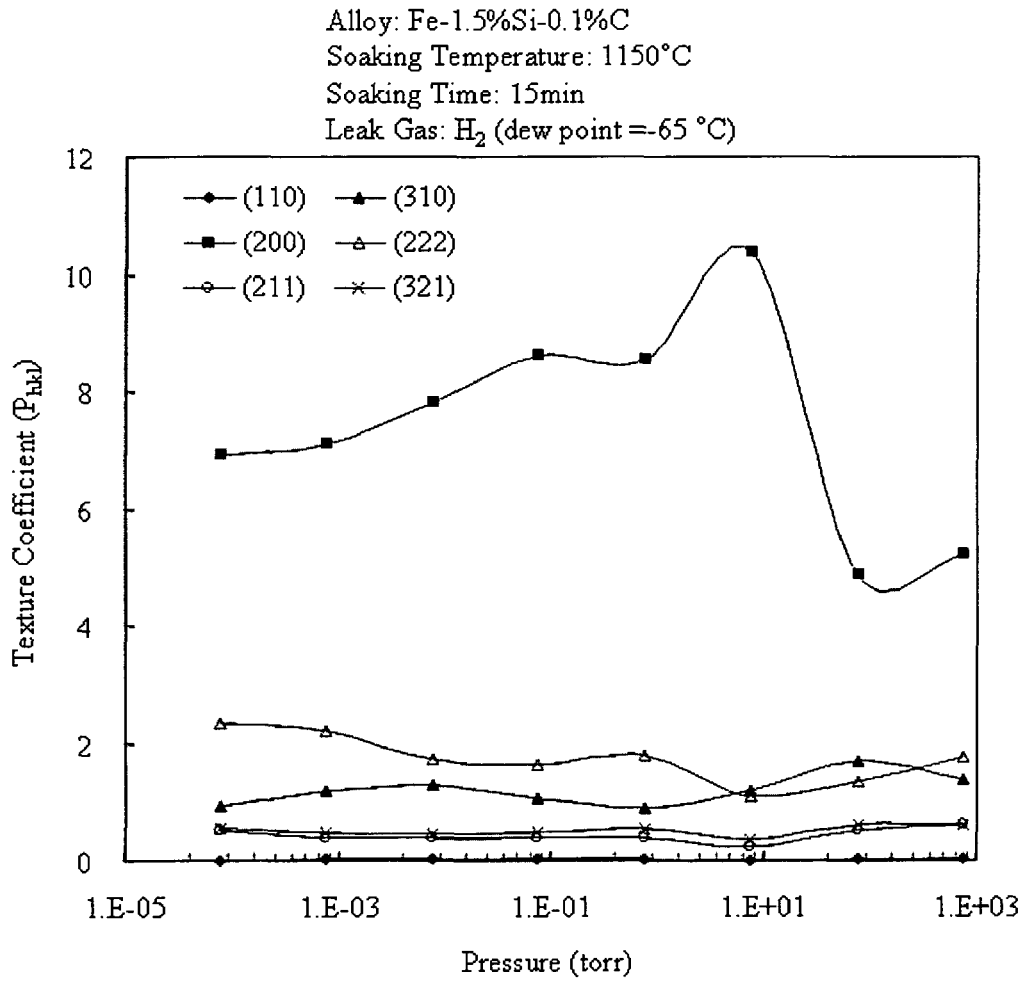
FIG. 11 is a graph showing an effect of hydrogen gas pressure on the formation of {100} texture, which was developed by annealing at 1150° C. for 15 minutes for Fe-1.5% Si-0.1% C.

Heat treatments of Fe-1.5% Si-0.1% C alloy were performed in the furnace at various pressure levels of $H_2$ gas. When temperature of the furnace reached 1150° C., samples were placed in the middle of the fun-ace. After holding at 1150° C. for 15 minutes, samples were pulled out from the furnace and cooled in the chamber at rooms temperature. During heat treatments, gas pressure was controlled using a rotary pump and needle valves of gas inlet and gas outlet ports. Leak gas was high purity $H_2$ gas with a dew point of approximately −65° C. As shown in FIG. 11, {100} texture develops well under hydrogen atmosphere at various pressure levels. Especially, strengthening of {100} texture is clearly found below 10 torr. Enhancement of {100} texture at low pressure might be due to i) fast removal of gas contaminated by the sample itself and by the heat treatment system or ii) slow kinetics of oxidation by low partial pressure $H_2O$. Similar behavior was observed in Fe-1% Si and Fe-2.5% Si-1.5% Mn-0.2% C. These results suggest that a high proportion of {100} texture develops by the $\gamma \rightarrow \alpha$ transformation under annealing atmospheres of various reducing gases.

An oxygen getter is an effective tool to remove oxygen and $H_2O$ in annealing atmospheres. Heat treatments of Fe-1.0% Si alloy were performed in 1 atm and 0.01 atm $H_2$ atmospheres. Dew point of the $H_2$ gas was −44° C., where no significant formation of {100} texture is expected. When the temperature of the furnace reached 1050° C., samples were placed in the middle of the furnace. After holding at 1050° C. for 10 minutes, samples were pulled out from the furnace and cooled in the chamber at room temperature. A pure titanium plate was located next to the sample as an oxygen getter. Since oxidation of titanium begins at oxygen partial pressure of around $1\times10^{-27}$ atm at 1050° C., oxygen partial pressure of the annealing atmosphere would be low enough so as not to oxidize Fe-1.0% Si. In hydrogen atmospheres, titanium getter removes water molecules. Table 3 shows that {100} texture is strengthened by the oxygen getter. In a 1 atm $H_2$ atmosphere, $P_{100}$ is 1.91 without Ti getter, whereas $P_{100}$ is 4.56 with Ti getter. Also, in 0.01 atm $H_2$ atmosphere, without Ti getter, $P_{100}$ is 4.57 whereas $P_{100}$ is 8.17 with Ti getter. These results suggest that oxygen getter materials can be used as an effective tool to remove oxygen and $H_2O$ in annealing atmospheres. The above results reconfirm that if oxygen or water molecules in annealing atmospheres are effectively removed, a high proportion of {100} texture develops by the $\gamma \rightarrow \alpha$ transformation.

TABLE 3

| Annealing Atmosphere | {110} | {100} | {211} | {310} | {111} | {321} |
|---|---|---|---|---|---|---|
| $H_2$, 1 atm | 0.02 | 1.91 | 0.62 | 0.84 | 3.41 | 1.00 |
| $H_2$, 1 atm, Ti getter | 0.02 | 4.56 | 0.60 | 0.90 | 2.44 | 0.81 |
| $H_2$, 0.01 atm | 0.02 | 4.57 | 0.66 | 1.03 | 2.60 | 0.69 |
| $H_2$, 0.01 atm, Ti getter | 0.03 | 8.17 | 0.40 | 0.80 | 2.02 | 0.58 |

Example 7

Carbon coating can strengthen {100} texture. Carbon can be an effective oxygen remover because carbon is readily reacting with oxygen on the surface, which is adsorbed from annealing atmospheres or segregated from the alloy. However, low carbon content is desirable because carbon significantly impairs magnetic properties of soft magnetic materials. Since carbon removes oxygen only on surfaces of the sheet, it is not necessary for alloys to have high carbon content in the matrix. Instead, carbon can be coated on bare surfaces of the sheet prior to the {100} forming heat treatment by a vapor deposition process or a carburization process.

An effect of carbon coating on {100} texture formation was evaluated using a Fe-1.5% Si alloy, which has carbon content of 50 ppm. Carbon coating was conducted through a carbon vapor deposition process at vacuum level of $3\times10^{-5}$ torr. 50 A of current flew through a graphite rod of 1 mm diameter for 15 and 25 seconds. It is expected that thickness of the carbon coating might be a few nanometer.

The heat treatments were performed in the vacuum furnace at vacuum pressure of $2.2\times10^{-5}$ torr. When temperature of the furnace reached 1150° C., samples were placed in the middle of the furnace. In Fe-1.5% Si alloy, austenite is stable at 1150° C. After holding at 1150° C. for 15 minutes, samples were pulled out from the furnace and cooled in the chamber at room temperature. As shown in Table 4, without carbon coating, {100} texture does not develop ($P_{100}$=0.41). Similar result can also be found in FIG. 5. However, samples with carbon coating show high density {100} texture. From these results, we can conclude that carbon coating can be utilized to eliminate the detrimental effect of oxygen in annealing atmospheres on forming {100} texture.

According to the result shown in Table 4, carbon can be an oxygen getter, also. When a sample without carbon coating is heat-treated with a sample with carbon coating together, unlike the results described above, the sample without carbon coating shows high density {100} texture ($P_{100}$=3.95). This result suggests that carbon coating layer acts as an oxygen getter in annealing atmospheres. Therefore without carbon coating, even in a poor vacuum atmosphere, a high proportion of {100} texture can be developed by the $\gamma \rightarrow \alpha$ transformation.

TABLE 4

| Surface Conditions | {110} | {100} | {211} | {310} | {111} | {321} |
|---|---|---|---|---|---|---|
| Bare Surface | 0.07 | 0.41 | 0.18 | 0.48 | 2.23 | 1.77 |
| C Coating, 15 sec | 0.05 | 5.87 | 0.72 | 0.92 | 2.23 | 0.60 |

TABLE 4-continued

| Surface Conditions | {110} | {100} | {211} | {310} | {111} | {321} |
|---|---|---|---|---|---|---|
| C Coating, 25 sec | 0.14 | 4.00 | 0.83 | 0.41 | 4.41 | 0.65 |
| Bare Surface* | 0.09 | 3.95 | 0.77 | 0.29 | 3.86 | 0.88 |

*annealed with the carbon coated alloy (C coating, 25 sec)

Carbon coating can play roles in removing oxygen on surfaces of the sheet or in the annealing atmosphere and also in stabilizing austenite phase in manganese containing alloys. In manganese containing alloy of Fe-2.5% Si-1.5% Mn, although its $A_3$ temperature is around 1045° C., {100} texture does not develop at all even with heat treatment at 1200° C. for 15 minutes in $6\times10^{-6}$ torr with Ti getter. Low manganese level near the surface of the sheet appears to be responsible for this result. As discussed earlier, at the temperature of interest, vapor pressure of manganese is very high (about 10000 times higher than iron). According to EDX analysis, manganese content near the surface is around 0.3%. Therefore, during the heat treatment, stable phase at the surface is ferrite. In this situation, since there is no $\gamma\rightarrow\alpha$ transformation on the surface, {100} texture does not develop.

TABLE 5

| Surface Conditions | {110} | {100} | {211} | {310} | {111} | {321} |
|---|---|---|---|---|---|---|
| Bare Surface | 0.00 | 0.81 | 1.89 | 0.00 | 8.98 | 0.00 |
| C Coating | 0.00 | 14.97 | 0.39 | 0.00 | 2.85 | 0.00 |

Carbon was coated on the above sample to maintain the surface phase austenite during the heat treatment. Carbon coating was performed using the same method described above for 15 seconds. Heat treatment was conducted at 1100° C. for 15 minutes in $6\times10^{-6}$ torr with Ti getter. As shown in Table 5, stabilization of austenite by carbon coating has a striking effect on forming {100} texture. Without carbon coating, {100} texture does not develop ($P_{100}$=0.81), whereas the sample with carbon coating shows a high density {100} texture ($P_{100}$=14.97). From this result, we know that coating of austenite stabilizing elements such as iron, manganese, nickel, and carbon can help manganese containing alloys to have a high proportion of {100} texture by the $\gamma\rightarrow\alpha$ transformation.

Example 8

In order to apply the present invention to commercial production, it is necessary to clearly define process variables such as cooling rate, heating rate, soaking time, and the like. According to the method disclosed in this invention, the $\gamma\rightarrow\alpha$ transformation in an oxygen deficient atmosphere is a major variable to form {100} texture. The $\gamma\rightarrow\alpha$ transformation comprises a step of nucleation of ferrite grains with {100} texture from austenite grains and a step of growth of those nuclei during the transformation. Therefore, it is necessary to scrutinize the effect of transformation kinetics on {100} texture. Also, texture in austenite can affect the final texture in ferrite because there are orientation relationships between austenite and ferrite grains. Therefore, texture in austenite seems to be very important in developing {100} texture in ferrite. Among the process variables, texture in austenite can be affected by soaking time and transformation kinetics can be affected by cooling rate.

Formation of {100} texture by the $\gamma\rightarrow\alpha$ transformation is not significantly affected by prior sample history such as degree of cold rolling, recrystallization temperature, and heating rate. Although those variables can affect preferred orientations in {100} texture, total proportion of grains with {100} plane parallel to the surface of the sheet is nearly the same or only marginally varies.

Figure 12:
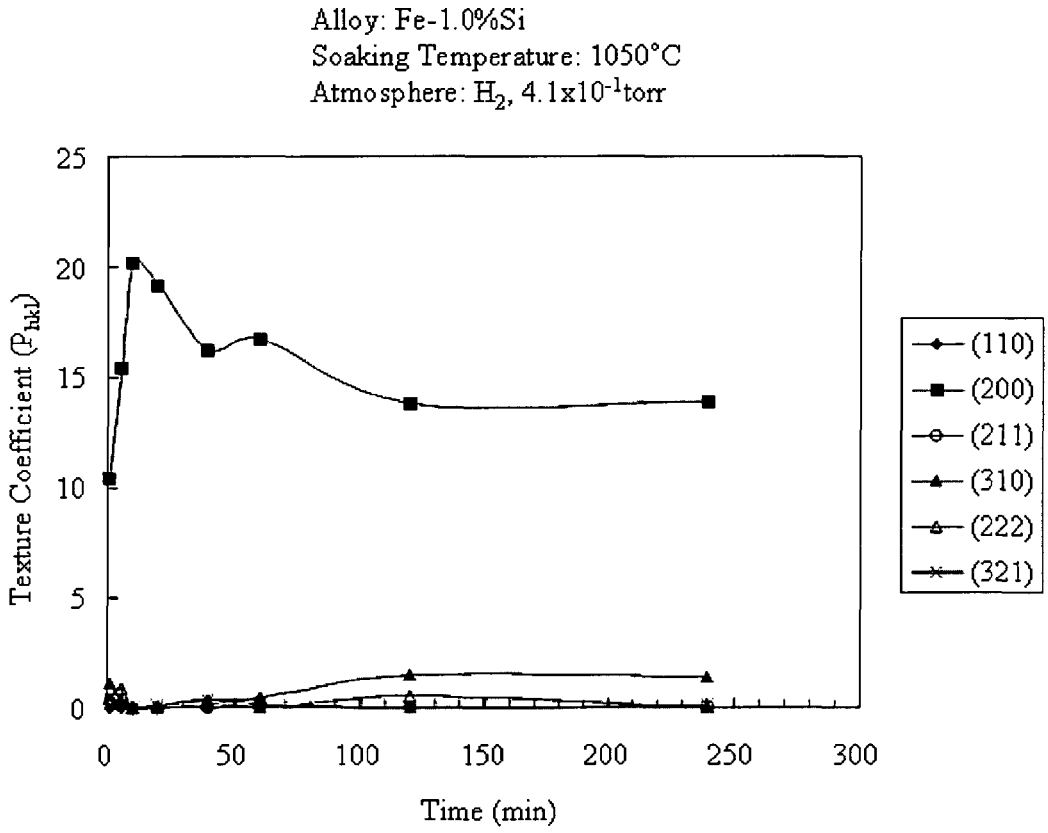
FIG. 12 is a graph showing an effect of soaking time on the formation of {100} texture, which was developed by annealing in $4.1\times10^{-1}$ torr $H_2$ at 1050° C. for Fe-1.0% Si.

Heat treatments were conducted at 1050° C. for various duration in $4.1\times10^{-1}$ torr $H_2$ (dew point=approximately −60° C.) with Fe-1.0% Si alloy to find the optimum soaking time. As shown in FIG. 12, although proportion of {100} texture varies with soaking time, {100} texture develops very well regardless of soaking duration. The optimum soaking time is 5 to 20 minutes. Prolonged exposure at soaking temperature weakens {100} texture, but it still has high proportion of {100} texture ($P_{100}$=approximately 14). Therefore, the recommended duration at soaking temperature is less than 20 minutes and preferably less than 10 minutes. Such a short soaking time makes it possible to build a continuous annealing furnace and also significantly reduces production costs.

Figure 13:
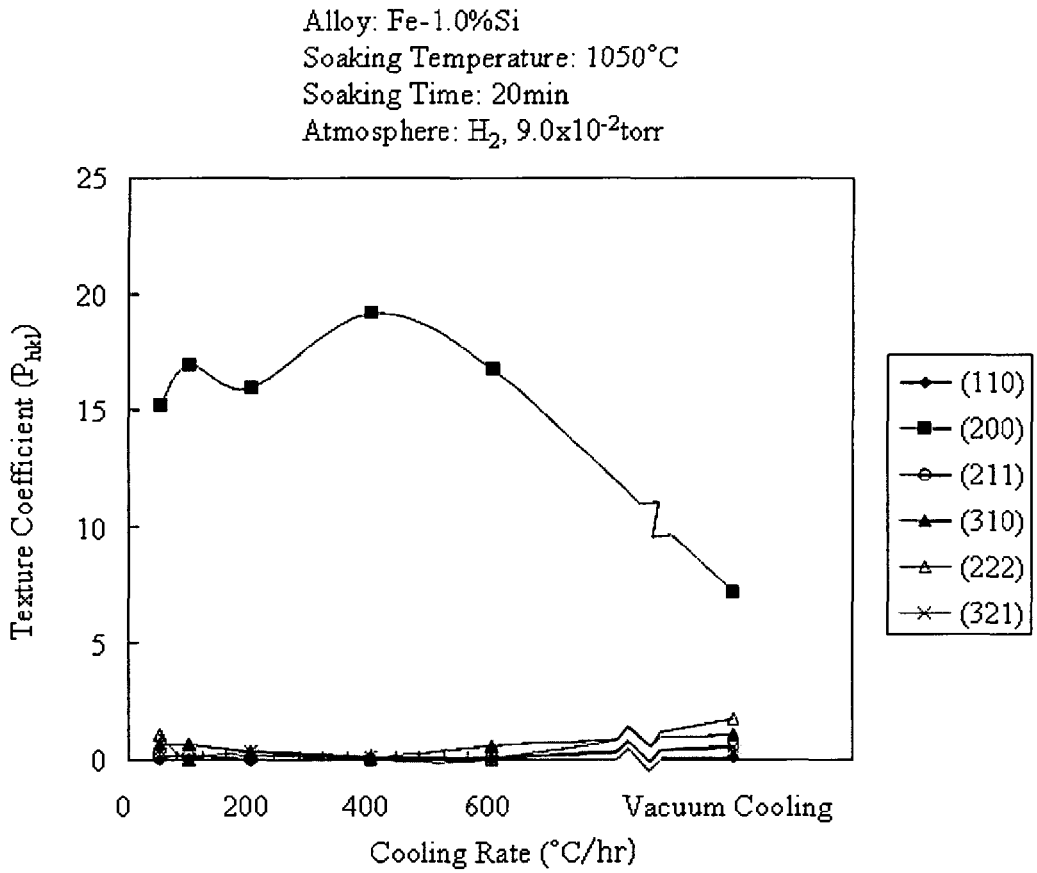
FIG. 13 is a graph showing an effect of cooling rate on the formation of {100} texture, which was developed by annealing in $9.0\times10^{-2}$ torr $H_2$ at 1050° C. for 20 minutes for Fe-1.0% Si.

The optimum cooling rate is less than 1000° C./hr. Heat treatments were conducted at 1050° C. for 20 minutes in $9.0\times10^{-2}$ torr $H_2$ (dew point=approximately −60° C.) with Fe-1.0% Si alloy. Then, samples were cooled to 1000° C. with cooling rate of 400° C./hr. Subsequently, samples were cooled to 950° C. with cooling rates of 50, 100, 200, 400, and 600° C./hr. In this alloy, ($\alpha+\gamma$) two phase field is 970 to 1000° C. At the conclusion of the heat treatment, samples were pulled out from the furnace and cooled in the chamber at room temperature. Also, one sample was pulled out directly from the furnace at 1050° C. and cooled in the chamber at room temperature (hereafter referred as vacuum cooling). As shown in FIG. 13, if the cooling rate is less than 600° C./hr, {100} texture develops very well regardless of cooling rate ($P_{100}$>approximately 15). However, if cooling rate is too high (for example, vacuum cooling), formation of {100} texture weakens ($P_{100}$=approximately 7). These results suggest that formation of {100} texture by the $\gamma\rightarrow\alpha$ transformation could be attributed to preferential nucleation of grains with {100} texture. As the cooling rate becomes high, the $\gamma\rightarrow\alpha$ transformation should be finished within a short period of time. In this case, though there is a tendency to form {100} texture due to anisotropy in surface energy, random nucleation also can happen; thus weak {100} texture develops. However, slowly cooled samples have enough time to selectively nucleate grains with {100} texture; thereby a prominent {100} texture develops.

Figure 14:
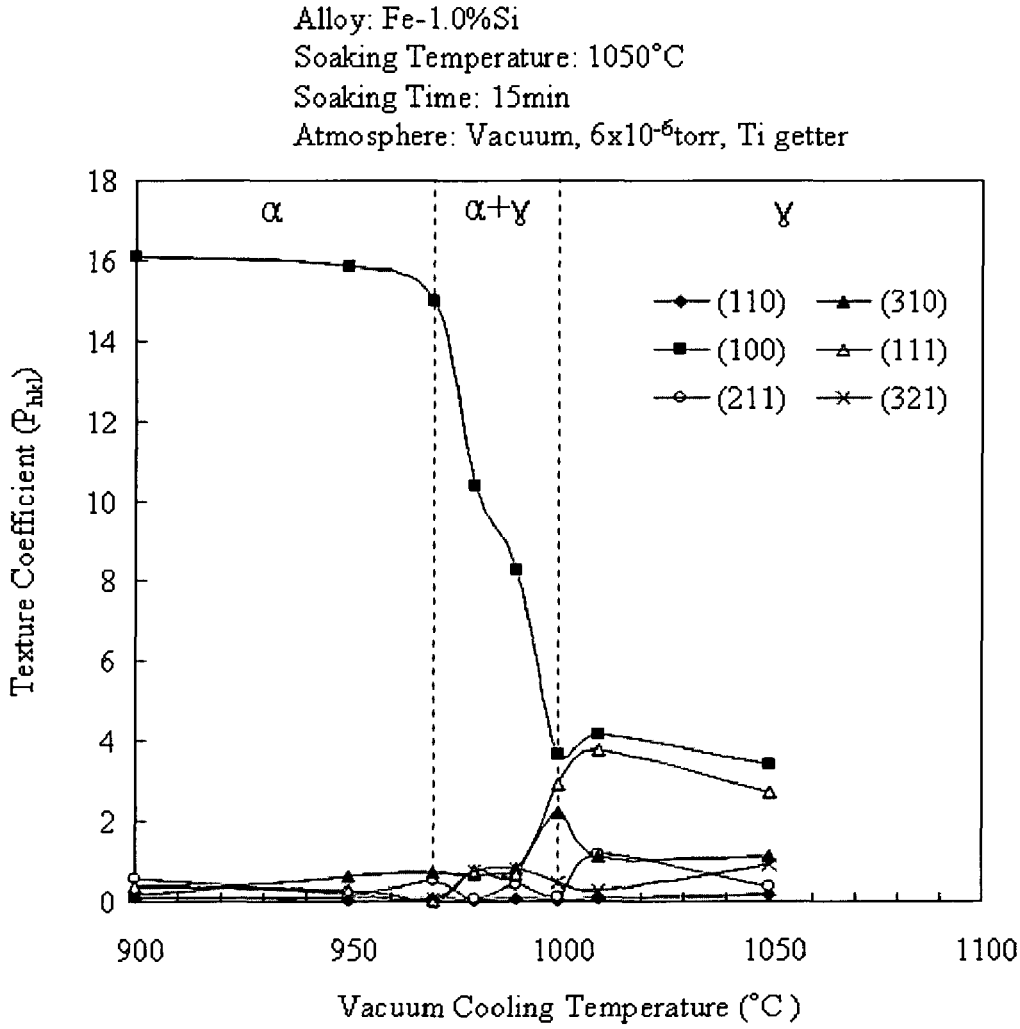
FIG. 14 is a graph showing an effect of vacuum cooling temperature on the formation of {100} texture, which was developed by annealing in a vacuum atmosphere of $6\times10^{-6}$ torr with Ti getter at 1050° C. for 15 minutes for Fe-1.0% Si.

Cooling rate at ($\alpha+\gamma$) two phase field is a very important factor in developing a high proportion of {100} texture. Heat treatments were conducted at 1050° C. for 15 minutes in a vacuum atmosphere ($4\times10^{-6}$ torr with Ti getter) with Fe-1.0% Si alloy. Then, samples were cooled to various temperatures with a cooling rate of 400° C./hr. At the conclusion of the heat treatment, samples were pulled out from the furnace and cooled in the chamber at room temperature (vacuum cooling). As shown in FIG. 14, when vacuum cooling is conducted at austenite temperature, weak {100} texture develops ($P_{100}$=approximately 4), whereas a high proportion of {100} texture develops with vacuum cooling at ferrite temperature range ($P_{100}$=approximately 16). When vacuum cooling is conducted at ($\alpha+\gamma$) two phase field (970 to 1000° C.), as transformation proceeds (as temperature is decreased), more {100} texture develops. Therefore, to obtain a high proportion of {100} texture, cooling rate at ($\alpha+\gamma$) two phase field should be appropriately controlled.

Cooling rate at ($\alpha+\gamma$) two phase field should be changed depending on chemical composition of alloys.

In carbon containing Fe—Si alloys, {100} texture develops well by rapid cooling, for example vacuum cooling. This is because formation of complex phases such as several types of carbides affects {100} texture formation. So, in carbon containing alloys, if complex phase formation is expected, fast cooling should be applied.

Figure 15:
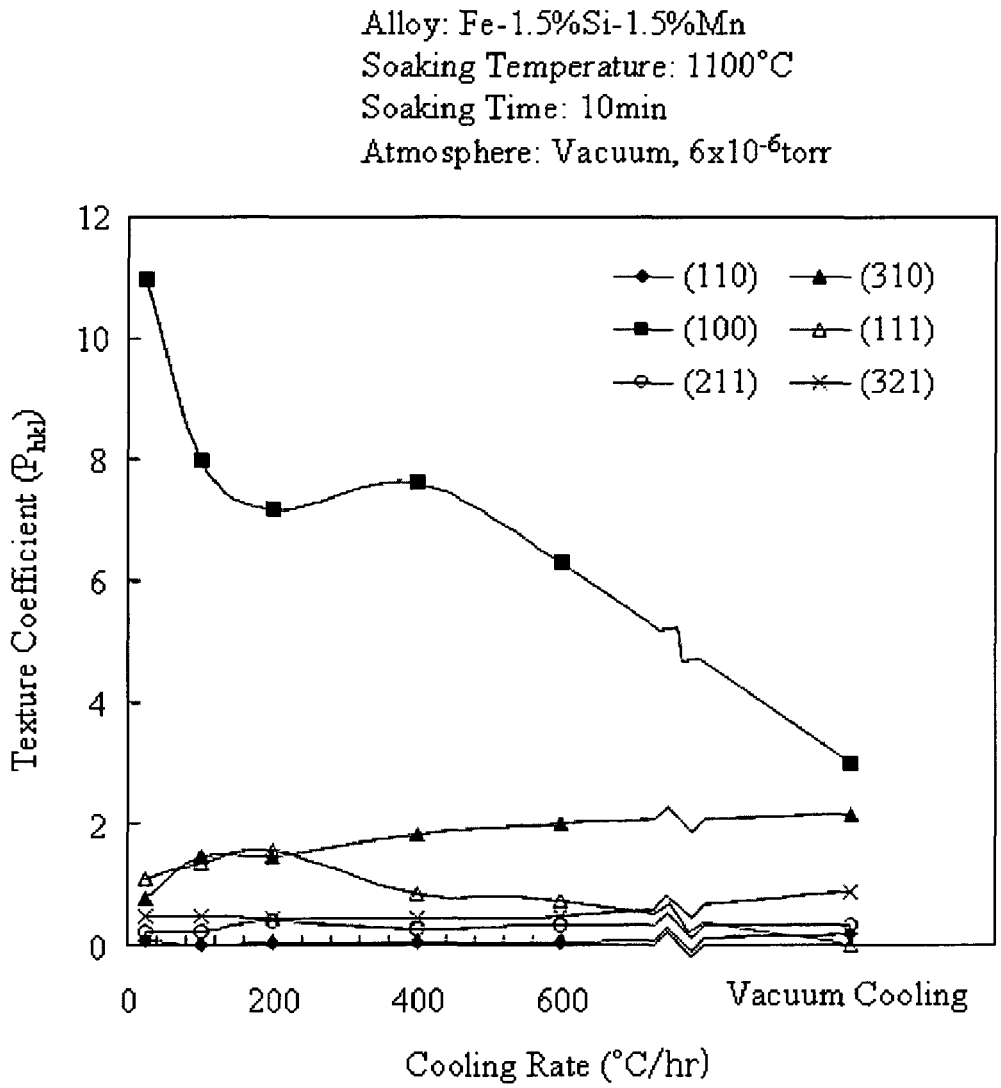
FIG. 15 is a graph showing an effect of cooling rate on the formation of {100} texture, which was developed by annealing in a vacuum atmosphere of $6\times10^{-6}$ torr at 1050° C. for 10 minutes for Fe-1.5% Si-1.5 Mn.

In manganese containing Fe—Si alloys, slow cooling is better for the formation of {100} texture. Heat treatments were conducted at 1100° C. for 10 minutes in a vacuum atmosphere ($6\times10^{-6}$ torr) with Fe-1.5% Si-1.5% Mn alloy. Then, samples were cooled to 850° C. with various cooling rates. At the conclusion of the heat treatment, samples were pulled out from the furnace and cooled in the chamber at room temperature. As shown in FIG. 15, cooling rate should be less than 600° C./hr, and preferably, less than 100° C./hr. Low mobility of α/γ phase boundaries appears to be responsible for a high proportion of {100} texture at low cooling rate. In manganese containing alloys, i) grain size is relatively small with respect to Fe—Si alloys without manganese and ii) as cooling rate becomes lower, grain size becomes bigger. Relationship between grain size and {100} texture can be explained utilizing a concept of low mobility of α/γ phase boundaries induced by manganese. Manganese tends to decrease mobility of α/γ phase boundaries. In this situation, if the cooling rate becomes high, the γ→α transformation should be finished within a short period of time. Though there is a tendency to form {100} texture due to the anisotropy in surface energy, random nucleation can happen; thus weak {100} texture develops during fast cooling. However, slowly cooled samples have enough time to grow selectively nucleated grains with {100} texture. Therefore, in manganese containing Fe—Si alloys, slow cooling is better for the formation of {100} texture.

Method of Manufacturing Non-Oriented Electrical Steels

In order to manufacture non-oriented electrical steels with superior magnetic properties, {100} texture with a proper grain structure is very important. In the previous description of forming {100} texture disclosed by this invention, application of the said technology is limited to the surface area of the sheet. To complete the texture control in non-oriented electrical steels with {100} texture, the grains with {100} texture on the surface layers should grow to have a grain size of at least half the thickness of the sheet. With this grain structure, non-oriented electrical steels with superior magnetic properties can be produced.

A method of manufacturing non-oriented electrical steel sheets comprises a step of forming a high proportion of {100} texture on surfaces of the sheet by the γ→α transformation while minimizing an effect of oxygen in the sheet, on surfaces of the sheet or in an annealing atmosphere, and a step of growing the surface grains with {100} texture inward to have a grain size of at least half the thickness of the sheet. The γ→α transformation can be induced by varying temperature (cooling), composition (decarburization and demanganization), or temperature and composition simultaneously.

In Fe, Fe—Si, and Fe—Si—Ni alloys, grain growth can be completed by so-called massive transformation induced by cooling. As temperature of the samples is decreased, the γ→α transformation will start at the surface of the samples. In this method, the grain growth completes with the completion of the γ→α transformation. As the γ→α transformation proceeds, ferrite grains with {100} texture, nucleated in austenite grains, grow into austenite grains. Since grain growth rate is very high in massive transformation, the resultant grain size of the ferrite exceeds the thickness of the sheet (generally, grain size of more than 400 μm). Therefore, grain growth by massive transformation is a very simple and efficient way to grow grains with {100} texture for non-oriented electrical steels. In this method, since the formation of {100} texture and the grain growth occur in a single process step, the γ→α transformation, it is not necessary to have an extra processing step for grain growth at all. If this method is used to manufacture non-oriented electrical steels, a continuous annealing process can be adopted.

In manganese containing alloys, the growth of grains with {100} texture on surfaces can also be accomplished by the γ→α transformation. However, in this case, since the grain growth appears to occur through volume diffusion, a cooling rate of samples should be sufficiently low enough to grow the surface grains with {100} texture inward with suppressing nucleation of new grains with other orientations. By alloying with manganese, Fe—Si alloys seem to lose characteristics of massive transformation such as a composition invariant, fast growing, interface-controlled, and the like. In manganese containing alloys, cooling rate at (α+γ) two phase field should be controlled to be less than 100° C./hr. In this method, although the formation of {100} texture and the grain growth occur in a single process step, the γ→α transformation, a batch annealing process is recommended to manufacture non-oriented electrical steels because the grain growth takes a long period of time.

In carbon containing alloys, the γ→α transformation induced by decarburization can be an effective tool to grow grains with {100} texture on the surface inward. There are several decarburizing atmospheres such as wet hydrogen, dry hydrogen, weak vacuum, and the like.

In a wet hydrogen atmosphere, decarburization takes place so rapidly that the grain growth can be completed within 10 minutes. In this method, samples obviously have grains with {100} texture on surfaces of the sheet before a decarburization process. A distribution of α and γ phases at a decarburizing temperature in the thickness direction of the sheet is very important. At the decarburizing temperature, surfaces of the sheet should be covered with ferrite grains with {100} texture, whereas the matrix phase should be austenite. When a diffusion-induced transformation occurs by removal of carbon, an austenite stabilizing element (decarburization), the ferrite grains with {100} texture on surfaces of the sheet will grow at the expense of austenite grains next to the ferrite grains to be columnar grains. In a wet hydrogen atmosphere, the surface grains should not be austenite because water vapor in the wet hydrogen atmosphere will act as a source of oxygen. Oxygen on the surface of the sheet will decarburize the sheet, and also destroy the existing {100} texture on surfaces of the sheet. Since a process time for decarburization is short, a continuous decarburization process can be adopted.

Example 9

Figure 16:
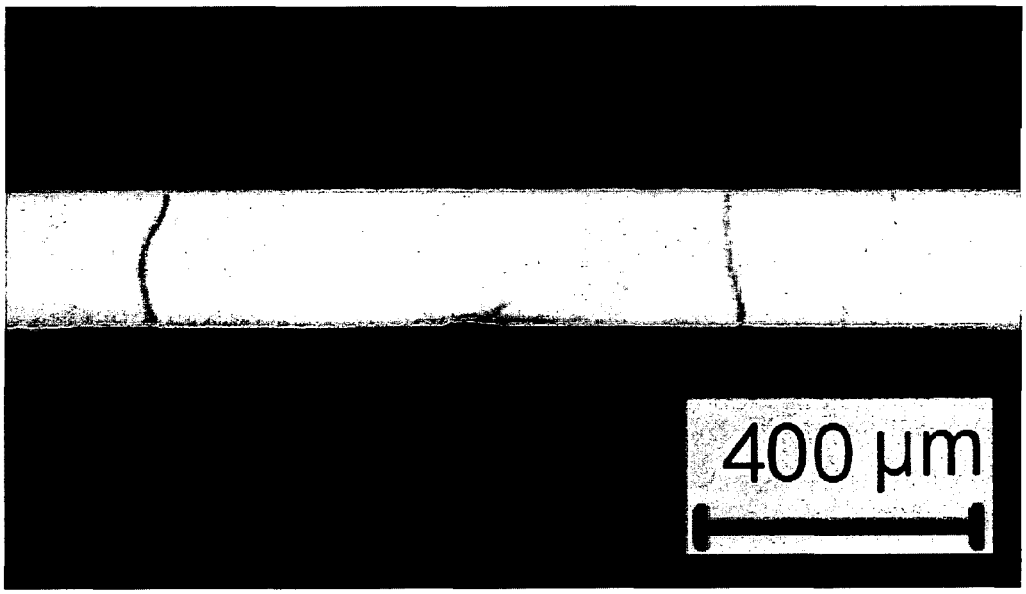
FIG. 16 is an optical micrograph of pure iron 1 showing well developed large columnar grains, which was developed by annealing in 1 atm gas $H_2$ atmosphere at 930° C. for 1 minute.
Figure 17:
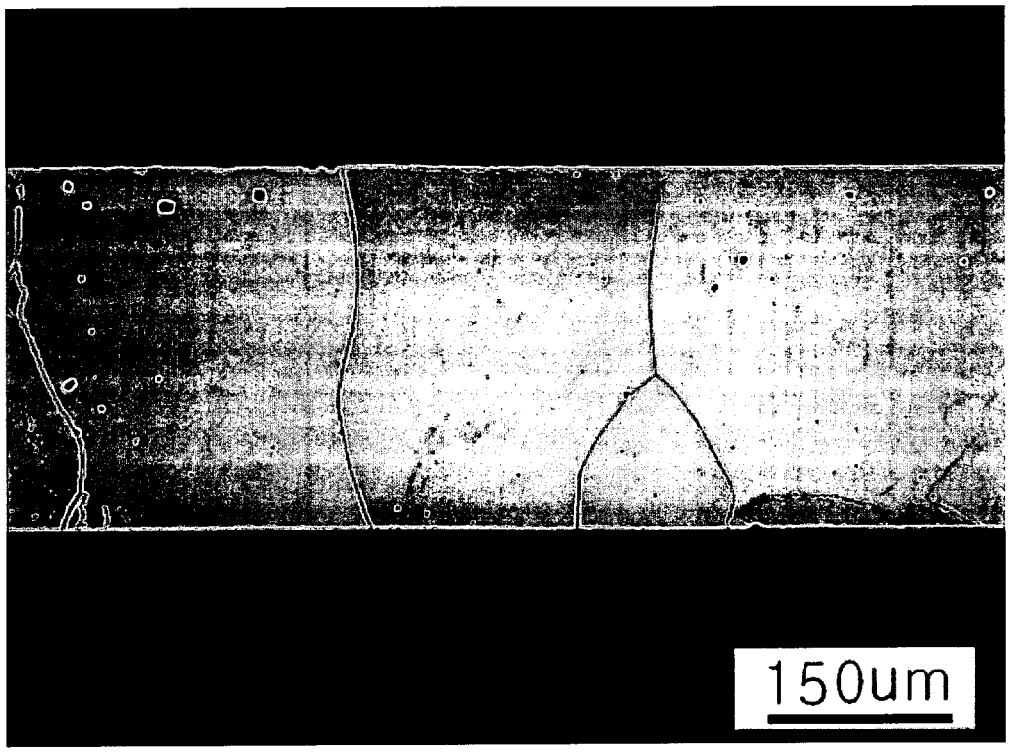
FIG. 17 is an optical micrograph of Fe-1.0% Si showing well developed large columnar grains, which was developed by annealing in a vacuum atmosphere of $6\times10^{-6}$ torr with Ti getter at 1150° C. for 15 minutes.

In Fe, Fe—Si, and Fe—Si—Ni alloys, large columnar grains with {100} texture is developed by the γ→α transformation induced by cooling in an oxygen deficient atmosphere. As shown in FIG. 1, after the heat treatment at 930° C. for 1 minute in 1 atm $H_2$ gas with a dew point of −54° C., a high proportion of {100} texture develops on the surface of iron ($P_{100}$=18.72). FIG. 16 shows an optical micrograph of a complete cross section of the sheet. An average grain size of the sample exceeds thickness of the sheet (850 μm vs 200 μm), and so-called columnar grains (or bamboo structure) develop. As temperature of the samples is decreased in an oxygen deficient atmosphere, the γ→α transformation will start at surfaces of the samples. As the temperature further decreases, ferrite nuclei with {100} texture grow inward at the expense of austenite grains. Since grain growth rate is very high in massive transformation, the resultant grain size of the ferrite grains exceeds the thickness of the sheet. A sheet with {100} texture is completed by developing the columnar grain structure, because texture on the surface is the same as that in the matrix. In Fe—Si alloys, similar grain growth behavior is observed. A sample of Fe-1.0% Si alloy was annealed at 1150° C. for 15 minutes in vacuum atmosphere of $6\times10^{-6}$ torr with Ti getter. FIG. 17 shows an optical micrograph of a complete cross section of the sheet. Large columnar grains with {100} texture are developed by the $\gamma\rightarrow\alpha$ transformation induced by cooling in an oxygen deficient atmospheres. In Fe—Si—Ni alloys, similar grain growth behavior is observed, also. A sample of Fe-2.0% Si-1.0% Ni was annealed at 1090° C. for 15 minutes in $4.1\times10^{-1}$ torr $H_2$ gas (Table 2). Large columnar grains with {100} texture is developed by the $\gamma\rightarrow\alpha$ transformation induced by cooling in an oxygen deficient atmosphere.

Columnar grain growth in commercial purity steels is not a common phenomenon. In fact, impurities in solution such as oxygen, and the like, seem to play an important role in grain growth. When a sample with oxygen content of 45 ppm was heat treated at 1000° C. for 30 minutes in a vacuum atmosphere of $6\times10^{-6}$ torr, {100} texture does not develop (FIG. 2) and no columnar grain is observed. Instead, small equiaxed grains exist as is the case for commercial purity steels. This result suggests that growth of columnar grains (massive transformation) depends on the purity of iron, especially purity of grain boundaries. Impurities tend to segregate at grain boundaries because impurity segregation can decrease grain boundary energy as well as elastic energy caused by impurity atoms. When the grain boundary moves, since the segregated atoms will attempt to remain at the boundary, mobility of the grain boundary is determined by slowly moving impurities. In the above case, interstitial oxygen atoms appear to play an important role in growing the columnar grains. In silicon containing alloys, silicon appears to act as an oxygen scavenger, and thereby grains grow fast to be columnar grains.

Grain boundary motion in austenite significantly affects the formation of {100} texture. When the same iron sample (oxygen content of 45 ppm) was heat-treated at 1200° C. for 30 minutes in a vacuum atmosphere of $6\times10^{-6}$ torr, {100} texture develops ($P_{100}$=3.49) (FIG. 2). In this case, although there are impurities at grain boundaries, due to the very high heat treatment temperature, grain boundary motion can be facilitated by fast diffusion of impurities and low level of impurity segregation. Thus, heat treatments at high temperature for a prolonged period of time in an oxygen deficient atmosphere can be an optimum condition to develop high density {100} texture for relatively impure alloys.

The formation of {100} texture and the growth of columnar grains can be explained as follows. Formation of austenite grains with certain texture in an oxygen deficient atmosphere appears to be an important precursor to form {100} texture in ferrite. In austenite phase of Fe and Fe-base alloys, there seems to be a distinctive anisotropy in surface energy. Under an oxygen deficient atmosphere, where intrinsic properties of metal surface appear, grains with low surface energy will grow preferentially. So, annealing at an austenite temperature in an oxygen deficient atmosphere develops austenite grains with a preferred texture (hereafter referred as the seed texture). Since there are orientation relationships between parent (austenite) and product (ferrite), an austenite grain with the preferred texture will be a seed grain of ferrite with {100} texture. The seed texture formed in austenite phase is expected to be {100} texture. This is because the final ferrite texture obtained by the $\gamma\rightarrow\alpha$ transformation is {100} texture. According to the Bain relationship, $\{100\}_\gamma$ transforms to $\{100\}_\alpha$. As temperature of a sample is decreased from an austenite temperature to a ferrite temperature in an oxygen deficient atmosphere, the nucleation of ferrite grains will start at the surface of the sample. As temperature further decreases, ferrite nuclei with {100} texture grow inward by sacrificing austenite grains. Formation of preferred texture (seed texture) in austenite phase under an oxygen deficient atmosphere can be limited by slow grain boundary motion due to impurities segregation at grain boundaries of the alloys, which is described above. Thus, although a heat treatment at austenite temperature in an oxygen deficient atmosphere provides a driving force to form grains with the seed texture, the growth of grains with the seed texture can be limited by sluggish kinetics of grain growth by slow grain boundary motion. Without austenite grains with the seed texture, no significant {100} texture develops in ferrite.

Figure 18:
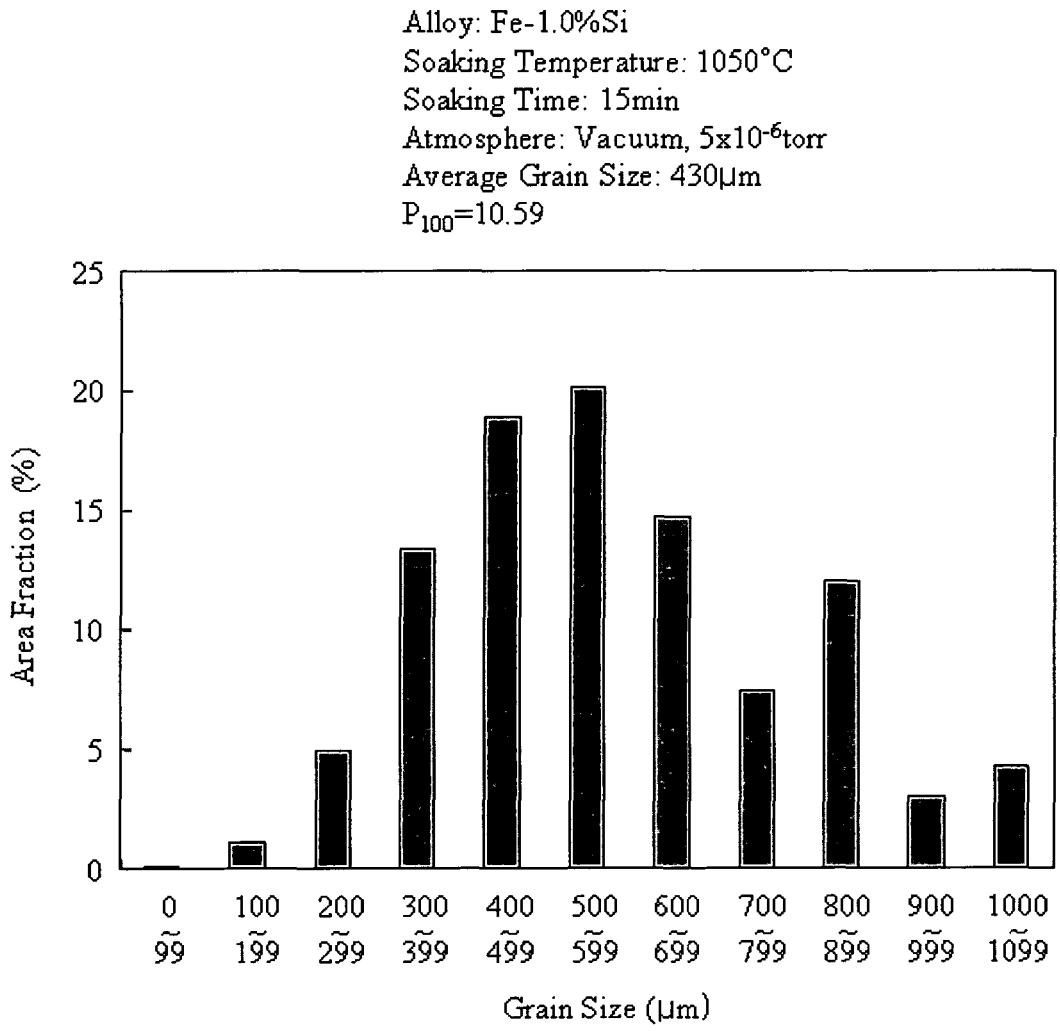
FIG. 18 is a graph showing a distribution of grain size of a Fe-1.0% Si sample annealed at 1050° C. for 15 minutes in a vacuum atmosphere of $5\times10^{-6}$ torr.

FIG. 18 shows a distribution of grain size of a Fe-1.0% Si sample annealed at 1050° C. for 15 minutes in vacuum atmosphere of $5\times10^{-6}$ torr. The average grain size is about 430 μm which exceeds the thickness of the sheet (300 μm). More than 90% of the surface area is filled with grains larger than 300 μm. Grain size of the largest grain is about 1.02 mm. In similarly treated Fe, Fe—Si, and Fe—Si—Ni alloys, more than 80% of the grains have a grain size of 0.2 to 1.5 mm and more than 80% of the grains are columnar grains.

This is a very simple and efficient method to complete non-oriented electrical steels with {100} texture because formation of {100} texture and grain growth occur simultaneously and rapidly.

Example 10

Figure 19:
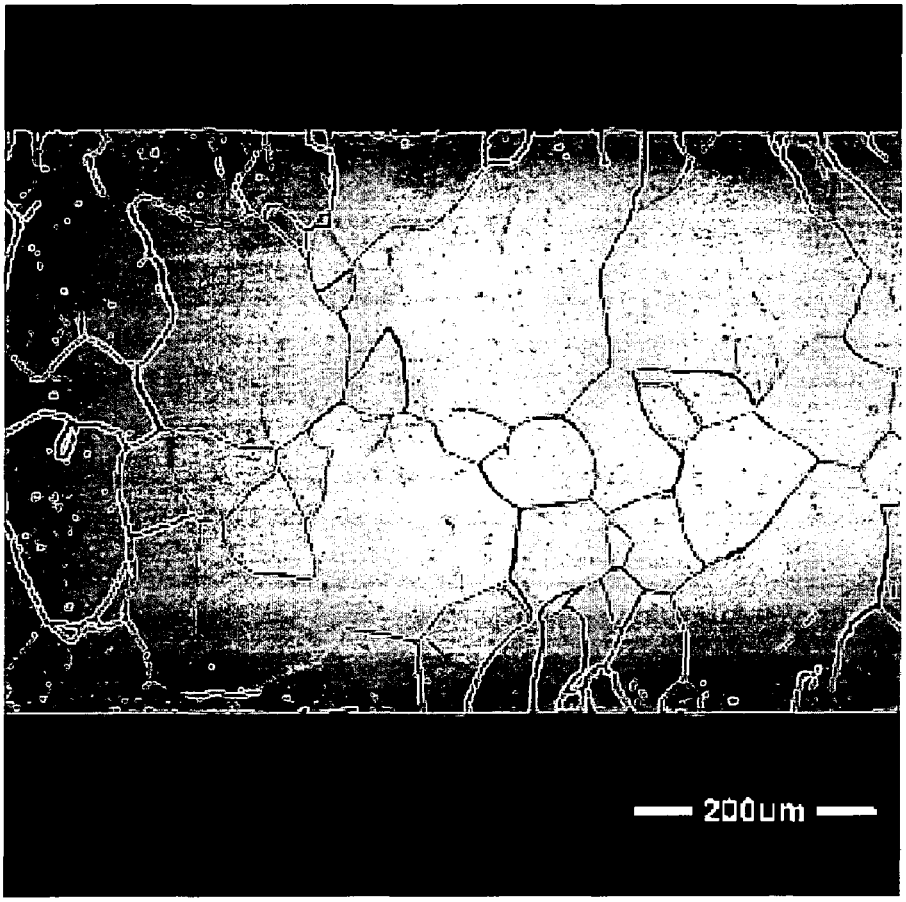
FIG. 19 is an optical micrograph of Fe-1.5% Si-0.7% Mn sample, which was annealed in a vacuum atmosphere of $6\times10^{-6}$ torr at 1100° C. for 10 minutes and subsequently cooled using vacuum cooling.
Figure 20:
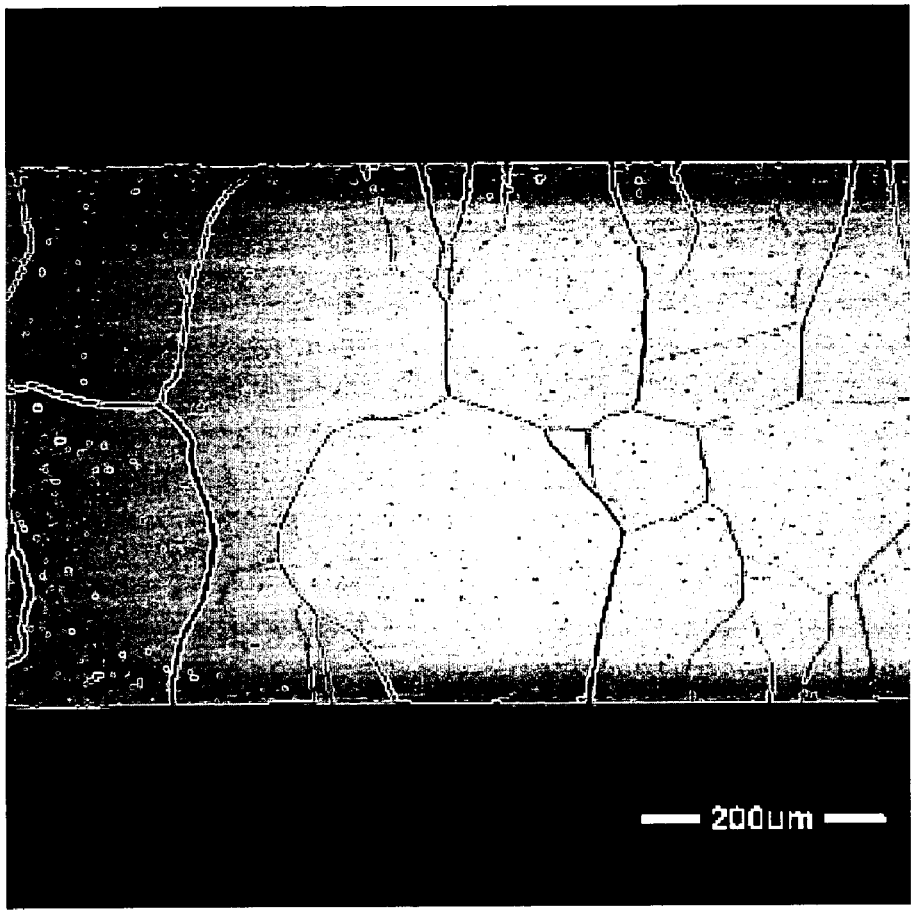
FIG. 20 is an optical micrograph of Fe-1.5% Si-0.7% Mn sample, which was annealed in a vacuum atmosphere of $6\times10^{-6}$ torr at 1100° C. for 10 minutes and subsequently cooled at a cooling rate of 25° C./hr.

In manganese containing Fe—Si alloys, growth of grains with {100} texture on the surfaces of the sheet can be accomplished by the $\gamma\rightarrow\alpha$ transformation. However in this case, since grain growth appears to occur through volume diffusion, cooling rate of samples should be sufficiently low to grow the surface grains inward while suppressing nucleation of new grains with random orientation. Heat treatments were conducted at 1100° for 10 minutes in a vacuum atmosphere ($6\times10^{-6}$ torr) with Fe-1.5% Si-0.7% Mn alloy. FIGS. 19 and 20 show optical micrographs of cross section of the sheets with two different cooling methods, vacuum cooling and a cooling rate of 25° C./hr. Microstructure of the sample with vacuum cooling shows small equiaxed grains with several large grains. Weak {100} texture ($P_{100}$=3.16) develops with no columnar grain. However, microstructure of the sample with a cooling rate of 25° C./hr shows large grains with a grain size larger than half the thickness of the sheet. Ferrite grains formed on surfaces grows into the center as well as in the direction parallel to surfaces to develop large columnar grains and thereby, texture on the surface is the same as that in the matrix. Also, strong {100} texture ($P_{100}$=10.81) develops. Therefore a sheet with {100} texture is completed by slow cooling at ($\alpha+\gamma$) two phase field. In manganese containing Fe—Si alloys, cooling rate at ($\alpha+\gamma$) two phase field should be controlled to be less than 100° C./hr, and the formation of the high proportion of the {100} texture on the surface of the sheet and the growth of the surface grains with the {100} texture inward is completed within about 10 hours.

Example 11

Figure 21:
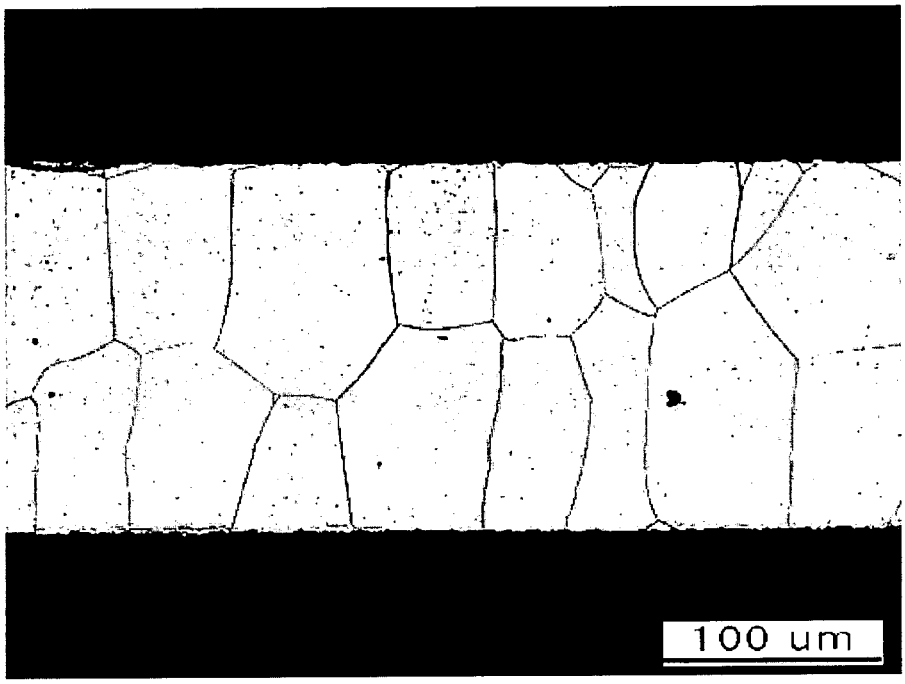
FIG. 21 is an optical micrograph of Fe-1.5% Si-0.1% C sample showing well developed columnar grains, which was developed by decarburization at 950° C. for 15 minutes in a wet hydrogen atmosphere.

In carbon containing alloys, the $\gamma\rightarrow\alpha$ transformation induced by decarburization can be an effective tool to grow grains with {100} texture on the surface inward. At decarburizing temperature, surface phase should be ferrite with {100} texture and the matrix phase should be austenite. When a diffusion-induced transformation occurs by decarburization, surface grains with {100} texture will grow to be columnar grains. Heat treatments were conducted at 1100° C. for 10 minutes in a vacuum atmosphere ($5\times10^{-6}$ torr) with Fe-1.5% Si-0.1% C alloy. In this sample, strong {100} texture develops on a thin surface layer ($P_{100}>8$). In order to grow the surface grains with {100} texture inward, decarburization annealing was conducted at 950° C. for 15 minutes in a wet $N_2$-20% $H_2$ mixture gas (dew point of 30° C.). Microstructure of the sample shows that columnar grains developed from both surfaces impinge at the center of the sheet thickness (FIG. 21), and thus, texture of the sheet is characterized by that of surfaces of the sheet. Also, strong {100} texture develops ($P_{100}=7.5$). Therefore a sheet with {100} texture is completed by decarburization in wet hydrogen atmosphere.

Non-Oriented Electrical Steel Sheet

According to the method disclosed by the present invention, a non-oriented electrical steel sheet has a portion of grains which penetrates the sheet in the thickness direction with {100} plane parallel to the surface. Therefore, the said non-oriented electrical steel sheet has a columnar grain structure with grains preferably penetrating through the thickness (bamboo structure). FIG. 16, FIG. 17, and FIG. 20 show the columnar structure described above. The said non-oriented electrical steel sheet has a high proportion of {100} texture with $P_{100}$ greater than 5, and if the optimum process is adopted, all the surface area of the sheet is filled with large columnar grains with {100} texture ($P_{100}$=approximately 20) (FIG. 12).

In the present invention, chemical composition of the non-oriented electrical steels comprises up to 4.5% silicon. Nickel is also contained in the non-oriented electrical steels, preferably up to 3.0%.

In addition, the non-oriented electrical steels have composition comprising 2.0 to 3.5% silicon and 0.5 to 1.5% nickel. In the said Fe—Si—Ni alloys, grain structure is columnar and {100} texture is prominent.

According to the present invention, the non-oriented electrical steels are characterized by a single phase field of austenite at a temperature over 800° C. Since the formation of {100} grains on surfaces and growth of the surface grains inward are achieved by the $\gamma\rightarrow\alpha$ transformation, the said characteristic with a high proportion of {100} texture can be distinctive evidence of utilizing the method disclosed by the present invention.

The non-oriented electrical steel sheet manufactured by another characteristic of the present invention has a columnar grain structure with grains penetrating at least half the thickness of the sheet. In this case, $P_{100}$ is greater than 5, also.

Since {100} texture is remarkably strong in the non-oriented electrical steels disclosed by the present invention, magnetic properties such as core loss, magnetic induction, and permeability of the non-oriented electrical steels are far superior to the existing non-oriented electrical steels.

According to the method of manufacturing non-oriented electrical steels of the present invention, non-oriented electrical steel sheets with a high proportion of {100} texture can be efficiently and effectively manufactured. The formation of {100} grains on surfaces and growth of the surface grains inward are achieved by a single process step, the $\gamma\rightarrow\alpha$ transformation, within a short period of time. Such a short process time enables building of a continuous annealing furnace for mass production and also significantly reduces production costs.

The method of the present invention can be generally applied to Fe and Fe-base alloys. Also, since the present invention discloses the detailed methods for alloys with various chemical compositions, non-oriented electrical steels having very high density {100} texture can be manufactured.

Since {100} texture is remarkably strong in the non-oriented electrical steels disclosed by the present invention, magnetic properties such as core loss, magnetic induction, and permeability of the non-oriented electrical steels are far superior to the existing non-oriented electrical steels.

Accordingly, the non-oriented electrical steel sheet of the present invention is most suited for use as materials for motors, generators, and the like.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The invention claimed is:

1. A method of developing a {100} texture on surfaces of Fe or a Fe-base alloy sheet comprising:

heat-treating the sheet at a temperature range where an austenite phase is stable and the surfaces of the sheet are not oxidized while minimizing an effect of oxygen in the sheet and/or on the surface of the sheet and/or in a heat-treatment atmosphere; and phase-transforming the heat-treated sheet by cooling from the austenite phase to a ferrite phase.

2. The method of claim 1, wherein the Fe-base alloys comprises at least one selected from the group consisting of Si, Ni, Mn, Al, Cu, Cr, C and P.

3. The method of claim 1, wherein an oxygen content of Fe or the Fe-base alloys is less than 40 ppm (ppm by weight).

4. The method of claim 1, wherein the austenite phase is stable throughout the entire sheet or at least in thin surface layers at the temperature of heat-treatment.

5. The method of claim 1, wherein the heat treatment is conducted in a vacuum atmosphere of less than $1\times10^{-3}$ torr.

6. The method of claim 1, wherein the heat treatment is conducted in a reducing gas atmosphere.

7. The method of claim 6, wherein i) the reducing gas atmosphere comprises at least one selected from the group consisting of $H_2$, a hydrocarbon and an inert gas; and ii) a dew point of a 100% $H_2$ gas atmosphere is less than −10° C.

8. The method of claim 6, wherein a pressure of the reducing gas is less than 0.1 atm.

9. The method of claim 1, wherein an oxygen getter material is spaced apart from the sheet by predetermined distance.

10. The method of claim 9, wherein the oxygen getter material is at least one selected from the group consisting of Ti, Zr and graphite.

11. The method of claim 1, wherein a Fe-base alloy comprises oxygen removing elements including at least one selected from carbon of less than 0.5 wt %, silicon of less than 6.5 wt %, and manganese of less than 3.0 wt %.

12. The method of claim 1, further comprising:

coating an oxygen removing element on the surface of Fe or the Fe-base alloys prior to the {100} forming heat-treatment.

13. The method of claim 12, wherein the oxygen removing coating material is selected from the group consisting of carbon and manganese.

14. The method of claim 1, wherein the cooling is performed by:

a cooling rate of 50 to 1000° C./hr when the Fe-base alloy is a Fe—Si alloy containing silicon of less than 3.0 wt %.

15. The method of claim 1, wherein the cooling is performed by:

a cooling rate of more than 600° C./hr when the Fe-base alloy is a Fe—Si—C alloy containing carbon in a range of 0.03 to 0.50 wt %.

16. The method of claim 1, wherein the cooling is performed by:

a cooling rate of less than 100° C./hr when the Fe-base alloy is a Fe—Si—Mn alloy containing manganese in a range of 0.1 to 3.0 wt %.

17. The method of claim 1, wherein the heat-treatment is performed within 20 minutes.

18. A method of manufacturing a non-oriented electrical steel sheet with a {100} texture comprising:

i) forming a high proportion of the {100} texture on the surface of the sheet by phase-transformation by cooling from an austenite (γ) to a ferrite (α) (γ→α) while minimizing an effect of oxygen in the sheet, on the surface of the sheet or in a heat-treatment atmosphere where the surfaces of the sheet are not oxidized; and ii) growing surface grains with the {100} texture inward.

19. The method of claim 18, wherein the formation of the high proportion of the {100} texture on the surface of the sheet is completed by the γ→α transformation induced either by cooling of the sheet from the austenite (γ) to the ferrite (α), and by removal of austenite stabilizing elements on the surfaces.

20. The method of claim 18, wherein the growth is completed by the γ→α transformation induced either by cooling of the sheet from the austenite (γ) to the ferrite (α) and by removal of austenite stabilizing elements.

21. The method of claim 18, wherein the non-oriented electrical steel sheet with the {100} texture has a grain size of at least half the thickness of the sheet.

22. The method of claim 18, wherein the formation of the high proportion of the {100} texture on the surface of the sheet and the growth of the surface grains with the {100} texture inward is completed within 30 minutes.

23. The method of claim 18, wherein when the non-oriented electrical steel consists of a Fe—Si—Mn alloy containing manganese of 0.1 to 1.5 wt %, a cooling rate during the γ→α transformation is less than 100° C./hr.

* * * * *